US007681872B2

(12) United States Patent
Hayashi

(10) Patent No.: US 7,681,872 B2
(45) Date of Patent: Mar. 23, 2010

(54) SHEET PROCESSING APPARATUS AND IMAGE FORMING APPARATUS

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 307 days.

(21) Appl. No.: 11/468,095

(22) Filed: Aug. 29, 2006

(65) Prior Publication Data

US 2007/0045919 A1 Mar. 1, 2007

(30) Foreign Application Priority Data

Aug. 31, 2005 (JP) ..... 2005-252901

(51) Int. Cl.
*B65H 37/04* (2006.01)

(52) U.S. Cl. ..... 270/37; 270/32; 270/45; 270/58.07; 270/58.11

(58) Field of Classification Search ..... 270/32, 270/37, 45, 58.07, 58.11; 271/416
See application file for complete search history.

(56) References Cited

U.S. PATENT DOCUMENTS

| | | | | |
|---|---|---|---|---|
| 5,443,248 | A | 8/1995 | Hayashi et al. | 270/53 |
| 5,499,811 | A | 3/1996 | Hayashi et al. | 271/293 |
| 5,678,818 | A | 10/1997 | Hayashi et al. | 271/292 |
| 5,735,515 | A | 4/1998 | Hayashi et al. | 270/58.11 |
| 5,836,579 | A | 11/1998 | Hayashi et al. | 270/58.16 |
| 5,938,186 | A | 8/1999 | Sato et al. | 270/58.11 |
| 5,951,000 | A | 9/1999 | Sato et al. | 270/58.11 |
| 6,076,825 | A | 6/2000 | Kato et al. | 271/207 |
| 6,220,592 | B1 | 4/2001 | Watanabe et al. | 270/241 |
| 6,702,279 | B2 | 3/2004 | Adachi et al. | 270/220 |
| 2006/0076726 | A1 * | 4/2006 | Kato et al. | 270/58.11 |
| 2006/0281620 | A1 * | 12/2006 | Hayashi et al. | 493/405 |
| 2007/0090582 | A1 * | 4/2007 | Awano | 270/37 |

FOREIGN PATENT DOCUMENTS

| | | | |
|---|---|---|---|
| JP | 11-193162 | | 7/1999 |
| JP | 2000103567 | A * | 4/2000 |
| JP | 2000255882 | A * | 9/2000 |
| JP | 2003-182928 | | 7/2003 |

* cited by examiner

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

The sheet processing apparatus is provided with a second folding, conveying roller pair that discharges a folded sheet bundle with its folded portion being the leading edge and a folded bundle tray provided below the second folding, conveying roller pair on which the sheet bundle discharged by the second folding, conveying roller pair is to be stacked and that moves the stacked sheet bundle. Before a succeeding sheet bundle is discharged onto a preceding sheet bundle, the folded bundle tray moves the preceding sheet bundle in the upstream direction with respect to the sheet conveyance direction to place the trailing edge of the preceding sheet bundle at a position upstream of the leading edge of the succeeding sheet bundle. Thus, it is possible to provide a sheet processing apparatus that can stack folded sheet bundles with reliability and to improve the image forming efficiency.

6 Claims, 26 Drawing Sheets

SHEET PROCESSING APPARATUS AND IMAGE FORMING APPARATUS

BACKGROUND OF THE INVENTION

1. Field of the Invention

The present invention relates to a sheet processing apparatus in which booklet-like bundles of folded sheets are stacked and an image forming apparatus provided with such a sheet processing apparatus in its main body. In particular, the present invention relates to a sheet processing apparatus in which the folded portion of a succeeding sheet bundle is prevented from entering an open portion opposed to the folded portion of a preceding sheet bundle.

2. Description of the Related Art

In some conventional image forming apparatuses for forming an image on a sheet, a sheet processing apparatus is equipped as a component of the apparatus. The sheet processing apparatus bundles sheets onto which images have been formed in the main body of the apparatus, binds the bundle and then folds it into a booklet form. In such a sheet processing apparatus, sheets are sequentially received on a tray to align edges of sheets to make a sheet bundle, binds the sheet bundle near a central portion in an edge part of the bundle, pushes the central portion by a pushing member to thrust the sheet bundle into the nip of a pair of rollers, and folds the sheet bundle by the pair of rollers while conveying it. In addition, Japanese Patent Application Laid-Open No. 2003-182928 discloses a sheet processing apparatus that performs a fold line processing to form a neat fold line.

The operation of such a conventional sheet processing apparatus will be described with reference to FIGS. 24 to 26. After the sheet processing apparatus aligns edges of multiple sheets in the sheet bundle on a collecting portion 70, it staples the central portion, with respect to the conveyance direction, of the sheets with a wire(s). Subsequently, the apparatus pushes the central portion of the sheet bundle P by a center folding plate 82 to thrust the sheet bundle into the nip between a first folding roller pair 83, 84. The first folding roller pair 83, 84 folds the sheet bundle while conveying it, and then temporarily stops it.

Then fold line enhancing process is performed using second folding rollers that are different from the first pair of folding rollers 83, 84 by holding the folded portion between a second folding roller or second folding rollers 85, and moving a holding member 851 that supports the second folding rollers 85 along the fold line (i.e. in the direction perpendicular to the conveyance direction). Thus, a center-folded sheet bundle (hereinafter referred to as "folded sheet bundle") that is folded at its center is obtained. Subsequently, the operation of the first folding roller pair 83, 84 is restarted, so that the sheet bundle is conveyed and discharged onto a tray 63.

In the conventional sheet processing apparatus, the sheet bundles must be stacked on the tray 63 in such a way that the trailing edge of the folded sheet bundle is positioned outside the operation region of the holding member 851 i.e., downstream with respect to the conveyance direction, so as not to interfere with the moving holding member 851 of the second folding roller 85. However, keeping such a positional relationship leads to a broad spacing between the trailing edge of the sheet bundles stacked on the tray 63 and the first folding roller pair 83, 84.

Accordingly, in some cases, the folded portion of the succeeding folded sheet bundle that is being discharged droops down and gets stuck with the rear edge of the preceding folded sheet bundle stacked on the tray 63. Consequently, the succeeding folded sheet bundle may abut the preceding folded sheet bundle or get into the open trailing end of the preceding folded sheet bundle, so that jamming of the folded sheet bundles, stack failure or bending of sheets sometimes occur.

The smaller the thickness of the sheets that constitute the folded sheet bundle is, the lower the stiffness of the sheets is, and the smaller the number of the folded sheets is, the more likely the folded sheet bundle droops down, and the more prominent the above-described problem is.

The above-described phenomenon also occurs in the case of a type of sheet processing apparatus in which the holding member 851 of the second folding roller 85 is not provided and the folded sheet bundle is delivered onto the tray 63 by the first folding roller pair 83, 84 without undergoing a fold line enhancing process.

As per the above discussion, in conventional sheet processing apparatuses, improper stacking of the folded sheet bundles sometimes occurs.

Provision of a sheet processing apparatus that suffers from improper stacking of folded sheet bundles in an image forming apparatus leads to a low image processing efficiency of the image forming apparatus as a whole.

SUMMARY OF THE INVENTION

An object of the invention is to provide a sheet processing apparatus in which when folded sheet bundles are stacked, the folded portion of a succeeding sheet bundle can be placed on an open portion opposed to the folded portion of a preceding sheet bundle in an overlapping manner whereby the folded portion of the succeeding sheet bundle is prevented from entering the open portion of the preceding sheet bundle.

Another object of the present invention is to provide an image forming apparatus having an improved image forming efficiency equipped with a sheet processing apparatus that can stack folded sheet bundles with reliability.

A further object of the present invention is to provide a sheet processing apparatus comprising a sheet discharge portion that discharges a folded sheet bundle with a folded portion being the leading edge and a sheet stack portion which stacks the folded sheet bundle discharged from said sheet discharge portion, the sheet stack portion being enabled to move the atacked sheet bundle in a sheet discharge direction, and in an opposite direction to the sheet discharge direction, wherein the sheet stack portion moves a preceding sheet bundle in the opposite direction so that the folded portion of a succeeding sheet bundle abuts an upper surface of the preceding sheet bundle, before the folded portion of the succeeding sheet bundle abuts the preceding sheet bundle stacked on the sheet stack portion.

An image forming apparatus according to the present invention is provided with an image forming portion that forms an image on a sheet and a sheet processing apparatus on which a sheet bundle formed by arranging the sheets into a bundle and folding it is stacked, the sheet processing apparatus being the above-described sheet processing apparatus.

In the sheet processing apparatus according to the present invention, the sheet stack portion is adapted to move the preceding sheet bundle to the upstream direction in the sheet discharging direction to position the open portion opposed to the folded portion of the preceding sheet bundle upstream of the folded portion of the succeeding sheet bundle before the succeeding sheet bundle is discharged onto the preceding sheet bundle on the sheet stack portion. Thus, the sheet processing apparatus according to the present invention can stack the sheet bundles in such a way that the folded portion of the succeeding sheet bundle is placed on the open side portion of the preceding sheet bundle in an overlapping manner thereby making it possible to prevent the folded portion of the succeeding sheet bundle from entering the open portion of the preceding sheet bundle and to minimize improper stacking.

Since the image forming apparatus according to the present invention is equipped with a sheet processing apparatus in which frequency of improper stacking of the sheet bundle is low, it possible to improve image forming efficiency.

Further features of the present invention will become apparent from the following description of exemplary embodiments (with reference to the attached drawings).

DESCRIPTION OF THE EMBODIMENTS

In the following, a finisher equipped with a saddle-stitching bookbinding section 800 that constitutes a sheet processing apparatus according to an embodiment of the present invention and an image forming apparatus provided with the finisher will be described with reference to the drawings.

Figure 2:
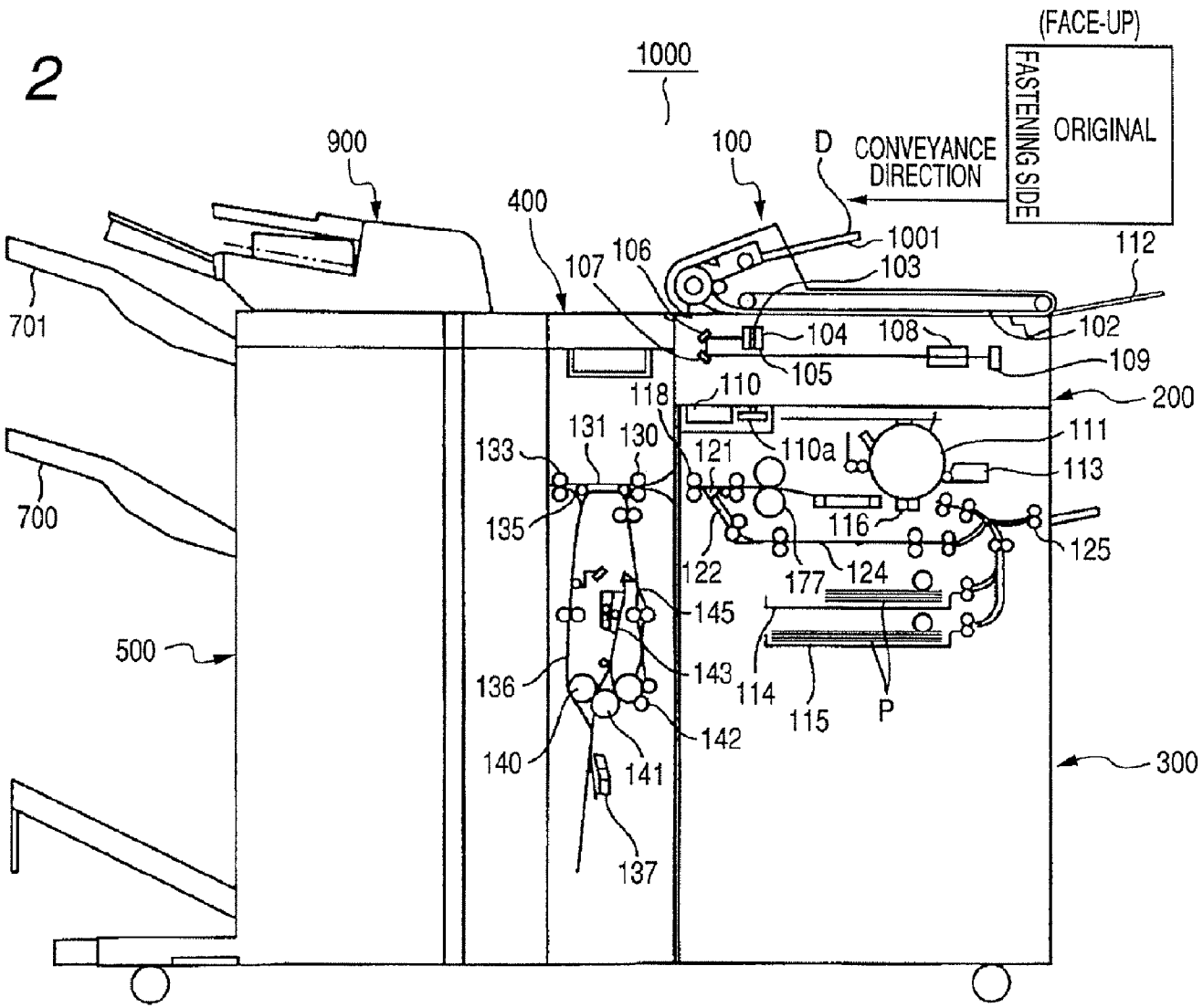
FIG. 2 is a cross-sectional view, taken along a sheet conveyance direction, of a copying machine as an image forming apparatus according to the embodiment of the present invention.

FIG. 2 is a cross-sectional view along the sheet conveyance direction, of the image forming apparatus according to the embodiment of the present invention.

A copying machine 1000 as an image forming apparatus has an original feeding portion 100, an image reader section 200, a printer section 300, a folding process section 400, a finisher section 500, an inserter section 900 and so on. The folding process section 400 and the inserter section 900 may be provided as optional equipment.

As shown in FIG. 2, on the tray 1001 of the original feeding portion 100 are set originals in the face-up state in which the surface having an image is facing upward. Here, it is assumed that the binding position of the originals is at the left side edge portion thereof in FIG. 2. The originals set on the tray 1001 are conveyed by the original feeding portion 100 page by page sequentially from the first page, toward the left with the binding side being the leading edge. Each original passes through a curved path and is conveyed on a platen glass 102 from left to right, and thereafter discharged onto the discharge tray 112. During this process, a scanner unit 104 is kept stationary at a predetermined original reading position.

The scanner unit 104 reads the image on the original that passes above the scanner unit 104, from left to right. This type of original reading method is called "flow reading". While the original travels on the platen glass 102, it is illuminated by a lamp 103 of the scanner unit 104. Light reflected by the original is guided to an image sensor 109 via mirrors 105, 106, 107 and a lens 108.

The image reader section 200 may alternatively perform such an original reading process in which the original is stopped and temporarily kept stationary on the platen glass 102 by the original feeding portion 100 and the scanner unit 104 is moved from left to right in that state to read the original. This reading method is called "stationary reading". When reading of an original is to be performed without using the original feeding portion 100, a user should set the original on the platen glass 102 by lifting up and then lowering the original feeding portion 100, and thereafter the scanner unit 104 performs the stationary reading.

A signal or signals image data of the original obtained by reading by the image sensor 109 is/are subjected to a predetermined image processing and sent to an exposure control portion 110. The exposure control portion 110 emits a laser beam in accordance with the signal or signals of image data. The laser beam is directed onto a photosensitive drum 111 in a scanning manner by a polygon mirror 110*a*. An electrostatic latent image corresponding to the scanning laser beam is formed on the photosensitive drum 111.

The electrostatic latent image formed on the photosensitive drum 111 is developed by the developing device 113 and visualized as a toner image. Meanwhile, a sheet (recording paper) P is conveyed to a transfer portion 116 from either one of a cassette 114, 115, a manual sheet feeding portion 125 and a double side conveyance path 124. Then, the visualized toner image is transferred onto the sheet in the transfer portion 116. The sheet on which the toner image has been transferred enters a fixing portion 177, where the toner image is fixed on the sheet. The photosensitive drum 111, the developing device 113 and other parts constitute an image forming portion.

The sheet having passed through the fixing portion 177 is once guided by a flapper 121 to a path 122. As the trailing edge of the sheet moves from of the flapper 121, it is conveyed in a switch-back manner and guided to the discharge rollers 118 by the flapper 121. The sheet is discharged from the printer section 300 by the discharge rollers 118. Thus, the sheet is discharged from the printer section 300 in the face-down state in which the side on which the toner image has been formed is facing downward. The above-described operation is referred to as "reverse discharge".

In the case where sheets are discharged out of the machine in the face-down state, the image forming process may be performed sequentially from the first page. For example, when the image forming process is performed using the original feeding portion 100 or when image forming process is performed based on image data from a computer, the order of the pages can be arranged in a correct sequence.

In the case where images are formed on both sides of a sheet, the printer section 300 guides the sheet directly from the fixing portion 177 to the discharge rollers 118, and just after the trailing edge of the sheet gets out of the flapper 121, the sheet is conveyed in a switch-back manner and guided to the double side conveyance path 124 using the flapper 121.

The copying machine 1000 according to the present invention is equipped with a saddle-stitching bookbinding section 800 in which the frequency of improper stacking of sheet bundle is low, and therefore, the efficiency of image formation can be improved.

Figure 1:
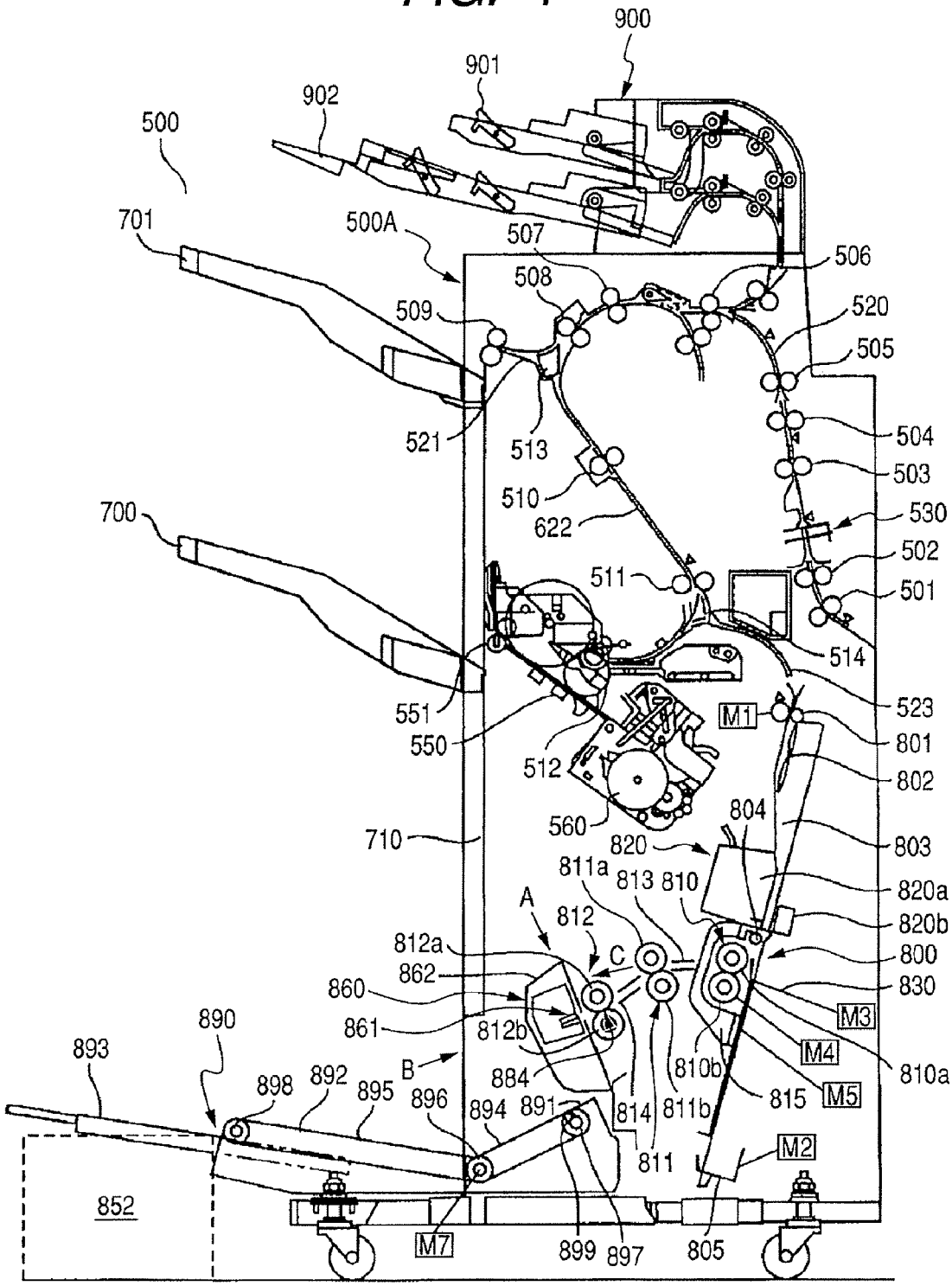
FIG. 1 is a cross-sectional view, taken along a sheet conveyance direction, of a finisher having a saddle-stitching bookbinding section serving as a sheet processing apparatus according to an embodiment of the present invention.

Next, the structure of the folding process section 400 and the finisher 500 will be described with reference to FIGS. 1 and 2. FIG. 1 is a cross-sectional view taken along the sheet conveyance direction of the finisher 500.

In FIG. 2, the folding process section 400 has a conveyance path 131 for receiving a sheet discharged from the printer section 300 and guiding it toward the finisher 500. A pair of conveying rollers 130 and a pair of discharge rollers 133 are provided in the conveyance path 131. A switching flapper 135 provided in the vicinity of the discharge roller pair 133 is adapted to guide the sheet conveyed by the conveying roller pair 130 toward the folding path 136 or the finisher 500.

When the folding process is to be applied on the sheet, the switching flapper 135 is switched to the folding path 136 side to guide the sheet to the folding path 136. The sheet guided to the folding path 136 is conveyed to folding rollers 140, 141 and folded into a Z shape (hereinafter referred to as "Z-folded").

In the case where the folding process is not to be performed, the switching flipper 135 is switched to the position for guiding the sheet toward the finisher 500. The sheet discharged from the printer section 300 is directly transferred to the finisher 500 through the conveyance path 131 and the switching flapper 135.

The sheet conveyed into the folding path 136 abuts a stopper 137 by its leading edge to form a loop, and then the sheet is folded by folding rollers 140, 141. This folded portion is caused to abut an upper stopper 143 to form a loop, and the loop is further folded by the folding rollers 141, 142. Thus, the sheet is Z-folded. The Z-folded sheet is guided through conveyance paths 145, 131 and discharged to the finisher 500 by a pair of discharge rollers 133. The folding process performed by the folding process section 400 is applied selectively.

The finisher 500 is adapted to perform various processes on sheets such as a bundling process of arranging multiple sheets conveyed from the printer section 300 through the folding process section 400 into a sheet bundle, a stapling process (or binding process) of stapling the sheet bundle at its trailing edge side, a sorting process and non-sorting process.

As shown in FIG. 1, the finisher 500 has a conveyance path 520 for taking a sheet having been conveyed through the folding process section 400 (FIG. 2) into the interior of the apparatus. In the conveyance path 520, there is provided conveying roller pairs 502 through 508 arranged in an order from an inlet roller pair 501 downstream in the sheet conveyance direction.

Between the conveying rollers 502 and the conveying rollers 503 is provided a punch unit 530. The punch unit 530 is adapted to perforate (or perform punching process on) the trailing edge portion of the conveyed sheet, when needed.

A flapper 513 provided at the end of the conveyance path 520 is adapted to switch the upper discharge path 521 and the lower discharge path 622 in the downstream direction thereof. The upper discharge path 521 is adapted to guide the sheet to a sample tray 701 by means of upper discharge rollers 509. On the other hand, in the lower discharge path 622, there is provided conveying roller pairs 510, 511 and 512. These roller pairs 510, 511 and 512 are adapted to convey the sheet and discharge it onto a processing tray 550.

Figure 11:
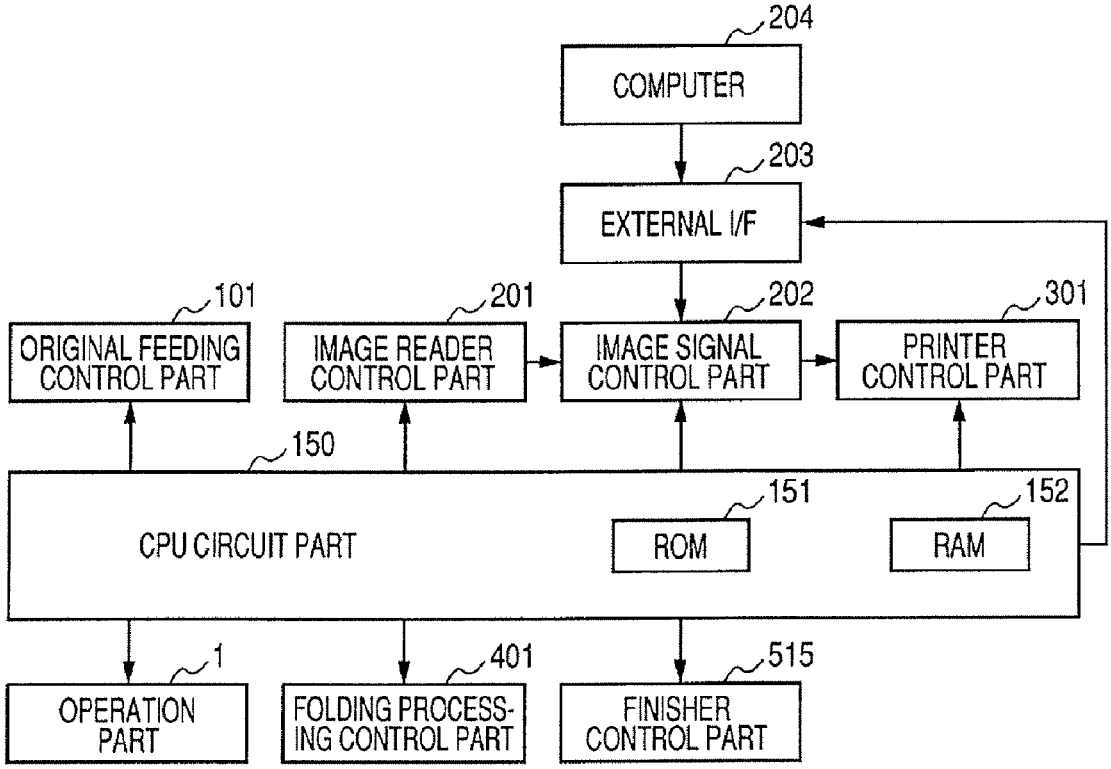
FIG. 11 is a block diagram of a control system of the entire copying machine.

The sheets discharged onto the processing tray 550 are arranged successively and stacked into a bundle, and a sorting process and a stapling process are performed thereon in accordance with setting established through an operating portion 1 (FIG. 11). The sheet bundle thus processed is discharged selectively onto a stack tray 700 or the sample tray 701 by the bundle discharge roller pair 551.

The above-mentioned stapling process is performed by a stapler 560. The stapler 560 is adapted to move along the width direction of the sheet (i.e. the direction transverse to the sheet conveyance direction) to staple the sheet bundle at a desired position. The stack tray 700 and the sample tray 701 are adapted to move up and down along the body 500A of the finisher 500. The upper sample tray 701 is adapted to receive sheets from the upper discharge path 521 and the processing tray 550. The lower stack tray 700 is adapted to receive sheets from the processing tray 550. In this way, a large amount of sheets can be stacked on the stack tray 700 and the sample tray 701. The trailing edges of the stacked sheets are received by a trailing edge guide 710 extending in the vertical direction so as to be aligned.

Next, the structure of the saddle-stitching bookbinding section 800 will be described.

In the following description, a process of folding a sheet bundle using a pair of folding rollers 810 and pushing member 830 will be referred to as the folding process. A process of creasing a sheet bundle on which a folding process has been applied using a pair of press rollers 861 to make a fold line or crease will be referred to as fold line processing. The folding process and fold line processing constitute in combination what is referred to in the following as sheet processing.

Although the saddle-stitching bookbinding section 800 in this embodiment is provided with the press roller pair 861, it is not essential.

A switching flapper 514 provided halfway in the lower discharge path 622 is adapted to switch the path of the sheet to the right side to guide it into a saddle discharge path 523 and then to the saddle-stitching bookbinding section 800. In the saddle-stitching bookbinding section 800, there is provided a saddle inlet roller pair 801, a flapper 802 driven by a solenoid in accordance with the sheet size, a storage guide 803 for storing sheets, a slide roller 804 and a sheet positioning member 805 arranged in the mentioned order from the entrance of the saddle-stitching bookbinding section 800.

The saddle inlet roller pair 801 and the slide roller 804 are adapted to be rotated by a motor M1. A stapler 820 is provided halfway in the storage guide 803 in an opposed manner with the storage guide 803 therebetween. The stapler 820 has a driver 820*a* that drives a wire staple and an anvil 820*b* for bending the wire staple driven onto it.

The sheet positioning member 805 is adapted to receive the leading edge (i.e. the lower edge) of the sheet when the sheet are convey to it, and its position can be adjusted in the up-and-down directions so that the center of the sheet with respect to the conveyance direction is aligned with the binding position of the stapler 820. The sheet positioning member 805 is moved up and down by a motor M2 and stopped at a suitable position associated with the sheet size.

In the downstream of the stapler 820 are a pair of folding rollers 810*a*, 810*b*. A thrust member 830 is provided at a position opposed to the folding roller pair 810*a*, 810*b*. The folding roller pair 810*a*, 810*b* and the thrust member 830 constitute the folding portion.

The thrust member 830 has a home position away from the storage guide 803 and is adapted to be driven by a motor M3 to project toward a bundle of sheets stored in the storage guide 803 thereby thrusting the sheet bundle into the nip of the folding roller pair 810*a*, 810*b*. After that, the thrust member 830 is returned to the home position. A pressure F1 sufficient for folding process for folding the sheet bundle is created between the two folding rollers 810 by means of a spring (not shown).

The sheet bundle having been folded by the folding roller pair 810 is discharged onto a folded bundle tray 890 via a first folding, conveying roller pair 811*a*, 811*b* and a second folding, conveying roller pair 812*a*, 812*b*.

A force F2, F3 enough to convey and stop the folded sheet bundle is also created between the rollers of each of the first folding, conveying roller pair 811 and the second folding, conveying roller pair 812.

A conveyance guide 813 is adapted to guide the sheet bundle between the folding roller pair 810 and the first folding, conveying roller pair 811. A conveyance guide 814 is adapted to guide the sheet bundle between the first folding, conveying roller pair 811 and the second folding, conveying roller pair 812. The folding roller pair 810, the first folding conveying roller pair 811 and the second folding, conveying roller pair 812 are driven by the same motor M4 (not shown) to rotate at a constant speed while holding the sheet bundle folded at a portion centered between both sides.

Folding of the sheet bundle that has been bound by the stapler 820 is performed after the sheet bundle is moved down by the sheet positioning member 805 from the position for sheet stapling process by a predetermined distance so that the stapled position on the sheet bundle is aligned with the position of the nip of the folding roller pair 810. Thus, the sheet bundle is folded at the stapled (or bound) portion.

A pair of alignment plates 815 have surfaces extending toward the storage guide 803 and are adapted to align the sheets stored in the storage guide 803 with respect to the width direction while the sheets rotate around the outer circumference of the folding roller pair 810*a*, 810*b*. The pair of alignment plates 815 are driven by a motor M5 to move the sheets in the holding direction to perform positioning of the sheets with respect to the width direction.

Downstream of the second folding, conveying roller 812 is a fold line press unit 860 serving as a folded portion processing unit. The fold line press unit 860 has a press holder 862 that supports a pair of press rollers 861 and is adapted to enhance the fold line by moving the press holder 862 while nipping the folded portion with the pair of press rollers 861, namely it is adapted to make the fold line definitely. Directly below the fold line press unit 860 is provided a first conveyor belt 894.

Figure 3:
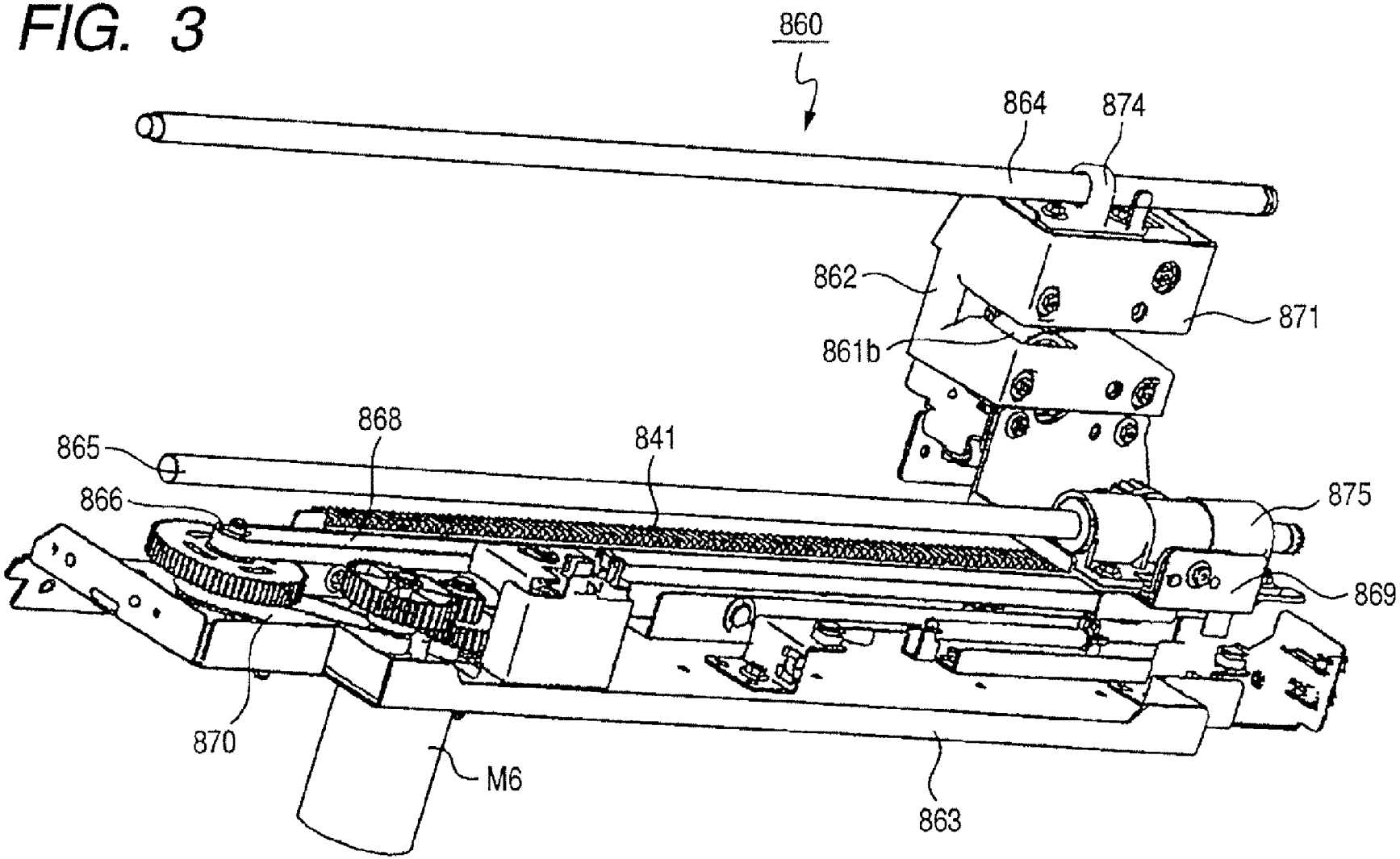
FIG. 3 is a schematic perspective view of the saddle-stitching bookbinding section as the sheet processing apparatus according to the embodiment of the present invention.
Figure 4:
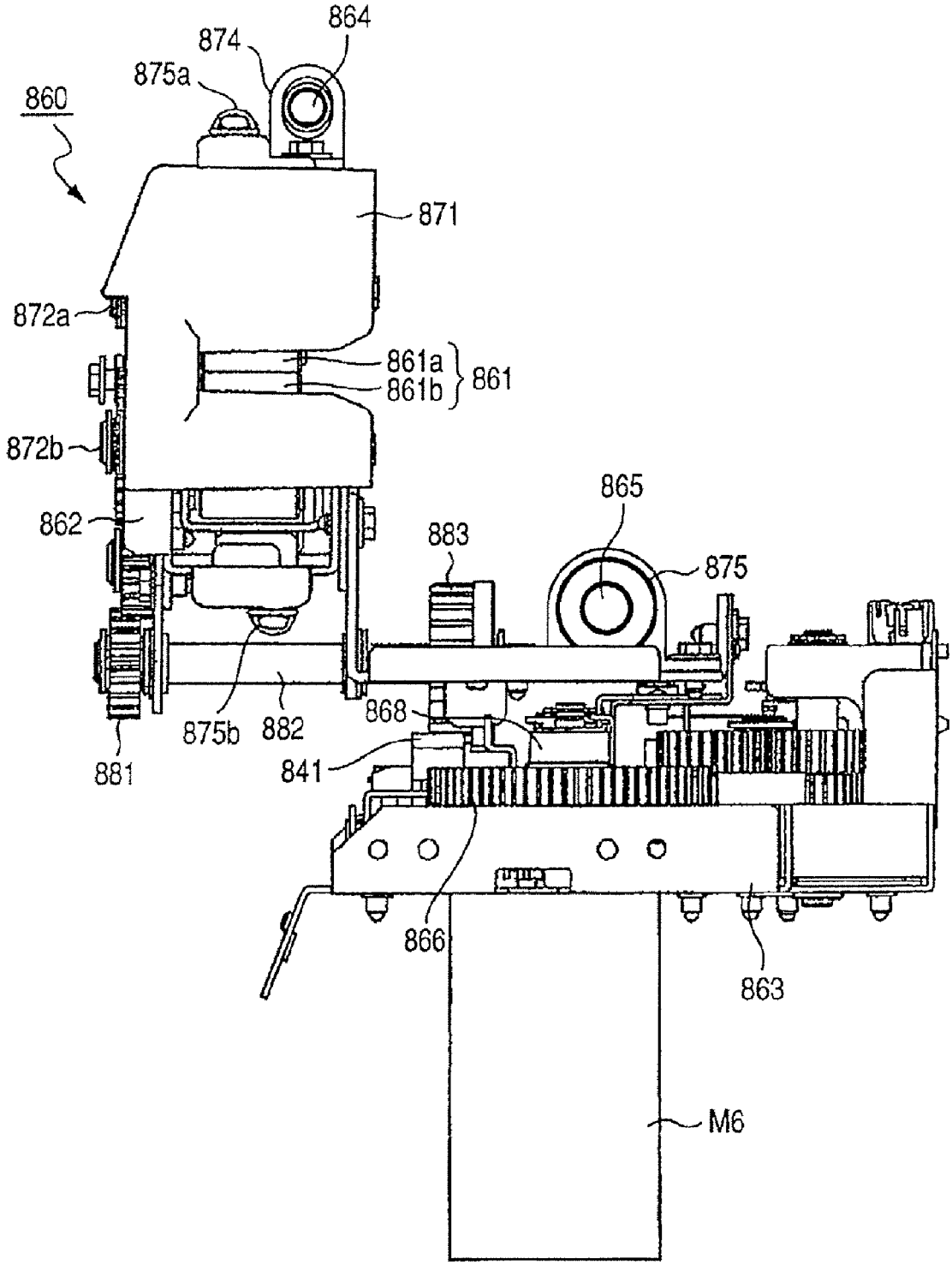
FIG. 4 is front view of a fold line press unit in the saddle-stitching bookbinding section shown in FIG. 3.
Figure 5:
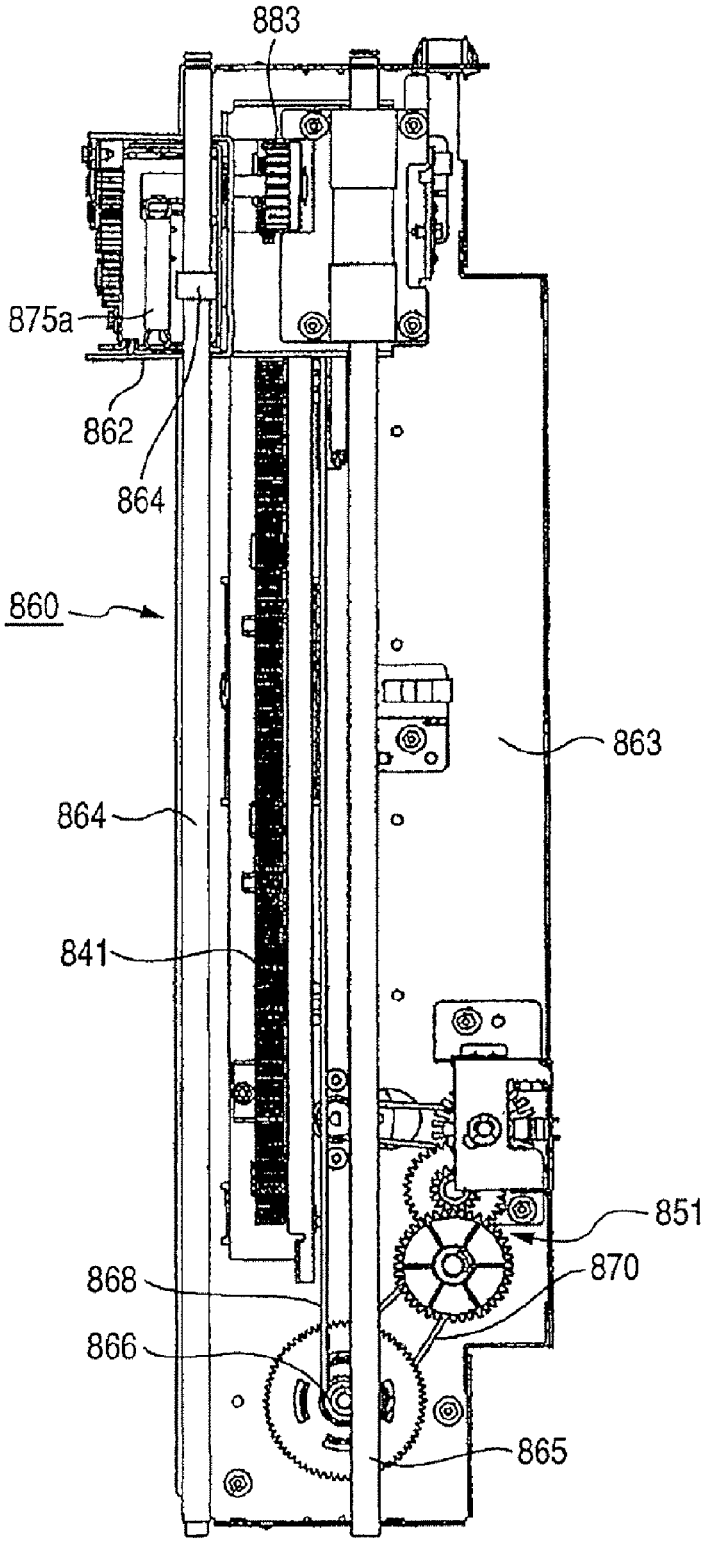
FIG. 5 is a view of the fold line press unit in the saddle-stitching bookbinding section shown in FIG. 3 as seen from the direction indicated by arrow A in FIG. 1.
Figure 6:
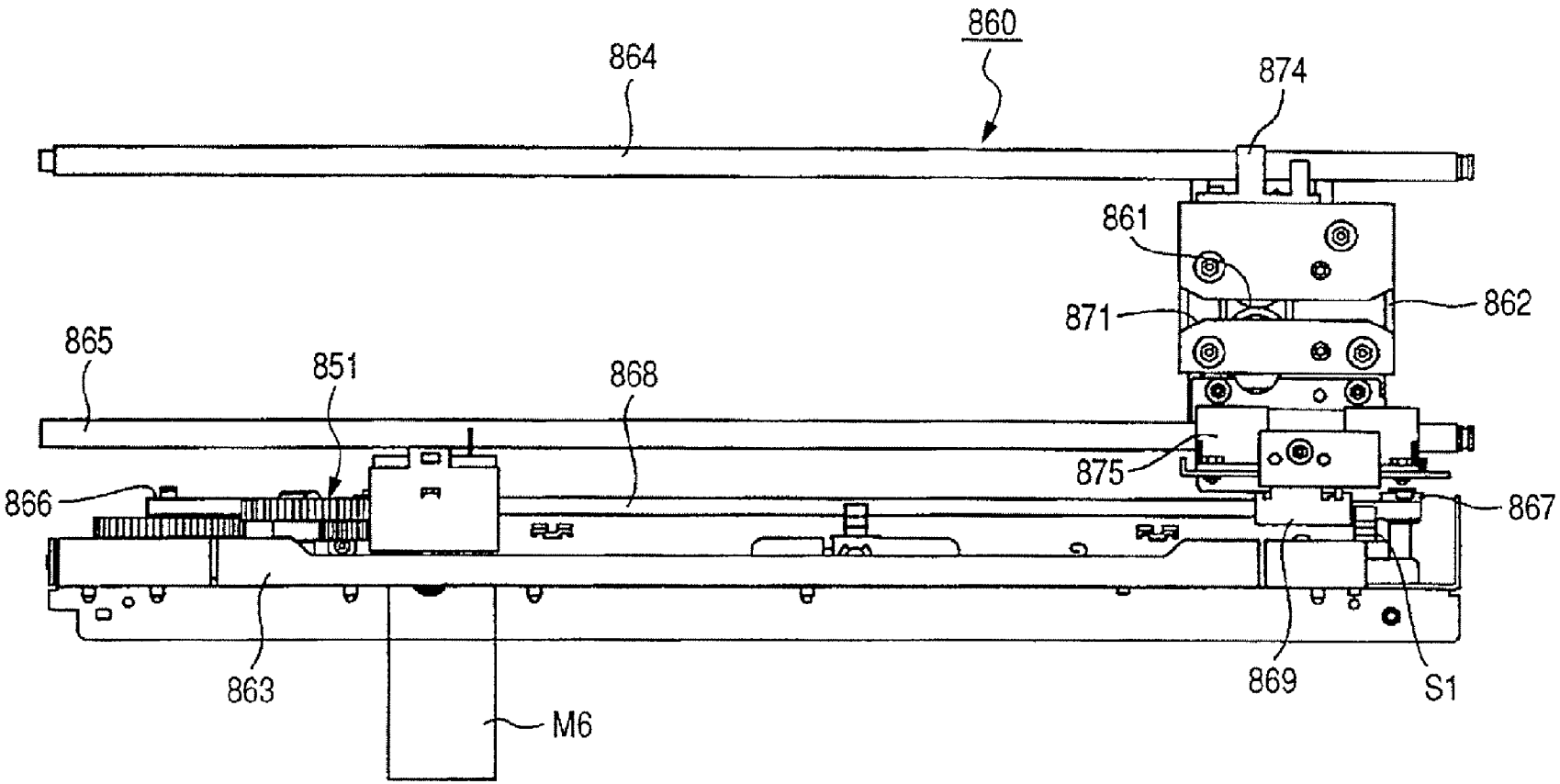
FIG. 6 is a view of the fold line press unit in the saddle-stitching bookbinding section shown in FIG. 3 as seen from the direction indicated by arrow C in FIG. 1.

Next, the structure of the fold line press unit 860 will be described. FIG. 3 is a perspective view of the fold line press unit. FIG. 4 is a front view of the fold line press unit. FIG. 5 is a view as seen from the direction indicated by arrow A in FIG. 1. FIG. 6 is a view as seen from the direction indicated by arrow C in FIG. 1.

The fold line press unit 860 has a metal base plate 863 on which principal parts are assembled and two slide shafts 864, 865 and is fixedly mounted on the front and rear side panels of the body 500A of the finisher. The two slide shafts 864, 865 are provided side by side and extending in the front-rear direction of the finisher 500 (FIG. 1). The slide shafts 864, 865 support the press holder 862 via slide bearings 874, 875 fixed on the press holder 862, respectively.

A timing belt 868 is looped around pulleys 866, 867 (FIG. 6) rotatably provided in front and rear of the metal base plate 863. A part of the timing belt 868 is attached to the press holder 862 by means of a linking metal sheet 869. On the pulley 866 is also wound a belt 870 (FIG. 5), which is linked with a motor M6 mounted on the metal base plate 863 via a gear train 851 for drive transmission. Thus, the press holder 862 is adapted to move along the front-rear (i.e. the frontward and backward directions for the operator) direction of the finisher 500 (i.e. the width direction of the sheet) as the motor M6 rotates.

The home position of the press holder 862 is in the rear side portion of the finisher 500. This position is detected by a home sensor S1 (FIG. 6). When the press holder 862 is at the home position, the sheet bundle can be discharged to the folded bundle tray 890 by the second folding, conveying roller pair 812.

In the following discussion, the press holder 862 will be described. It should be noted that illustration of a sheet guide 871 (FIGS. 3, 4 and 6) for introduction into the press roller pair 861 that is attached on the press holder 862 is omitted in some of the drawings to facilitate understanding of the structure.

Figure 7:
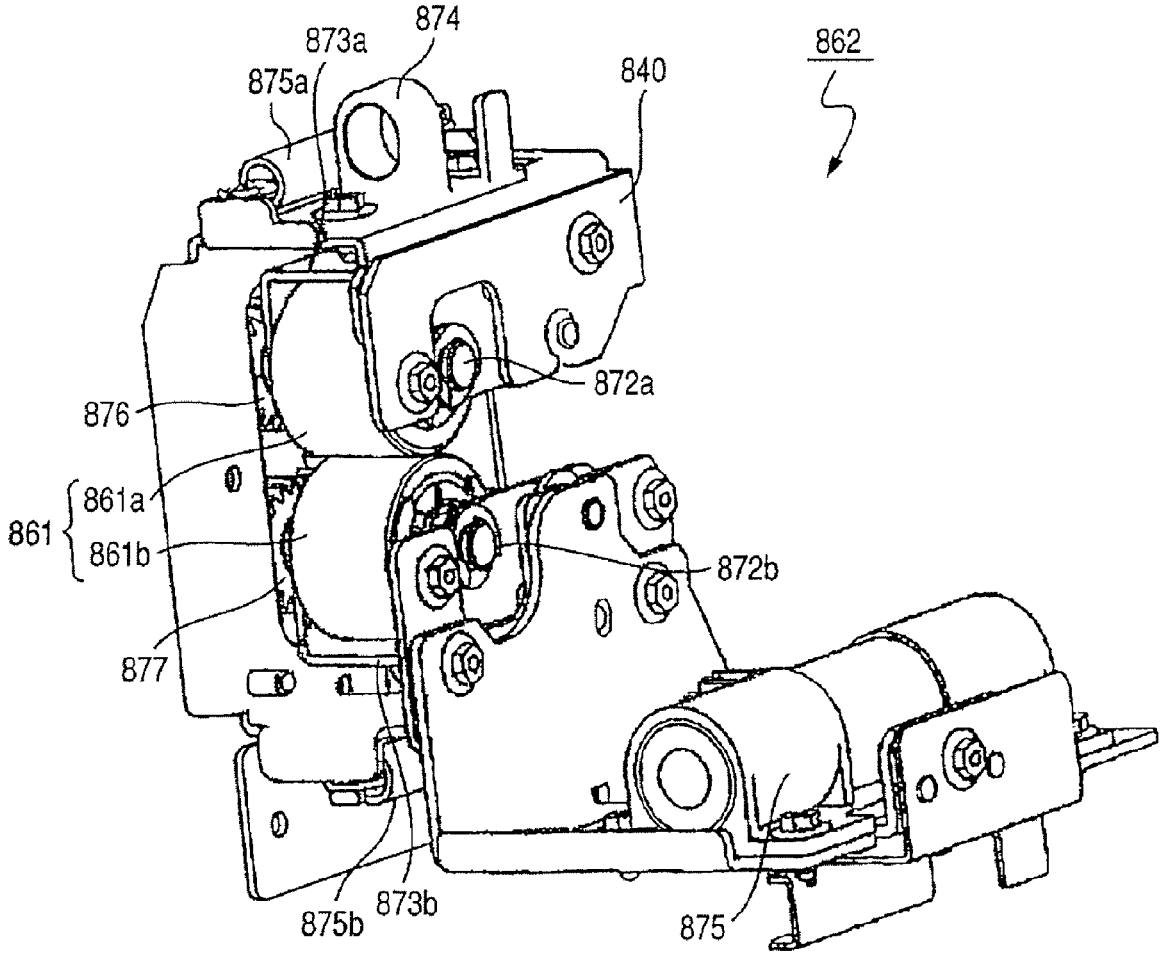
FIG. 7 is a perspective view showing an outer appearance of a press holder portion of the fold line press unit.
Figure 8:
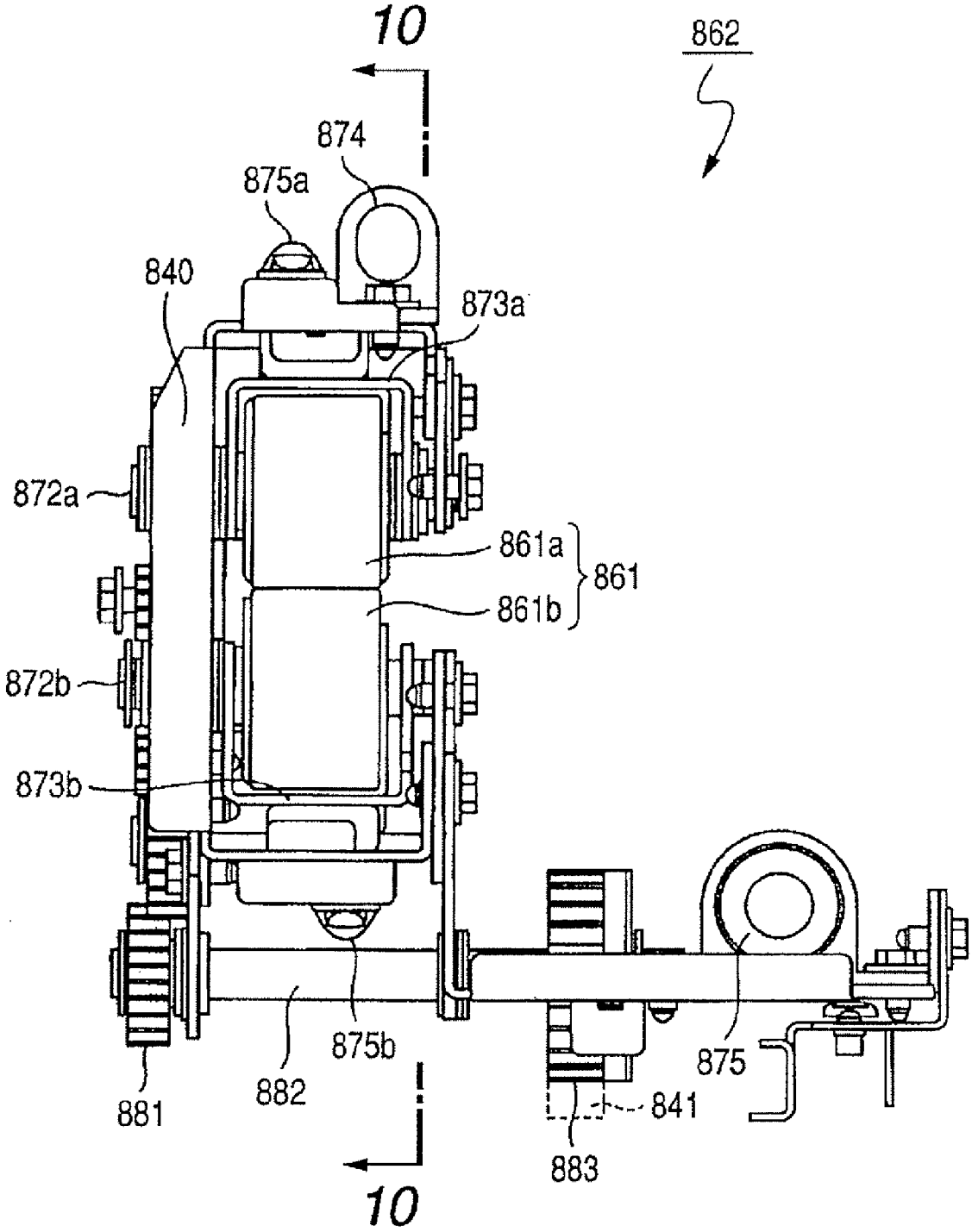
FIG. 8 is a front view of a press holder portion of the fold line press unit.
Figure 9:
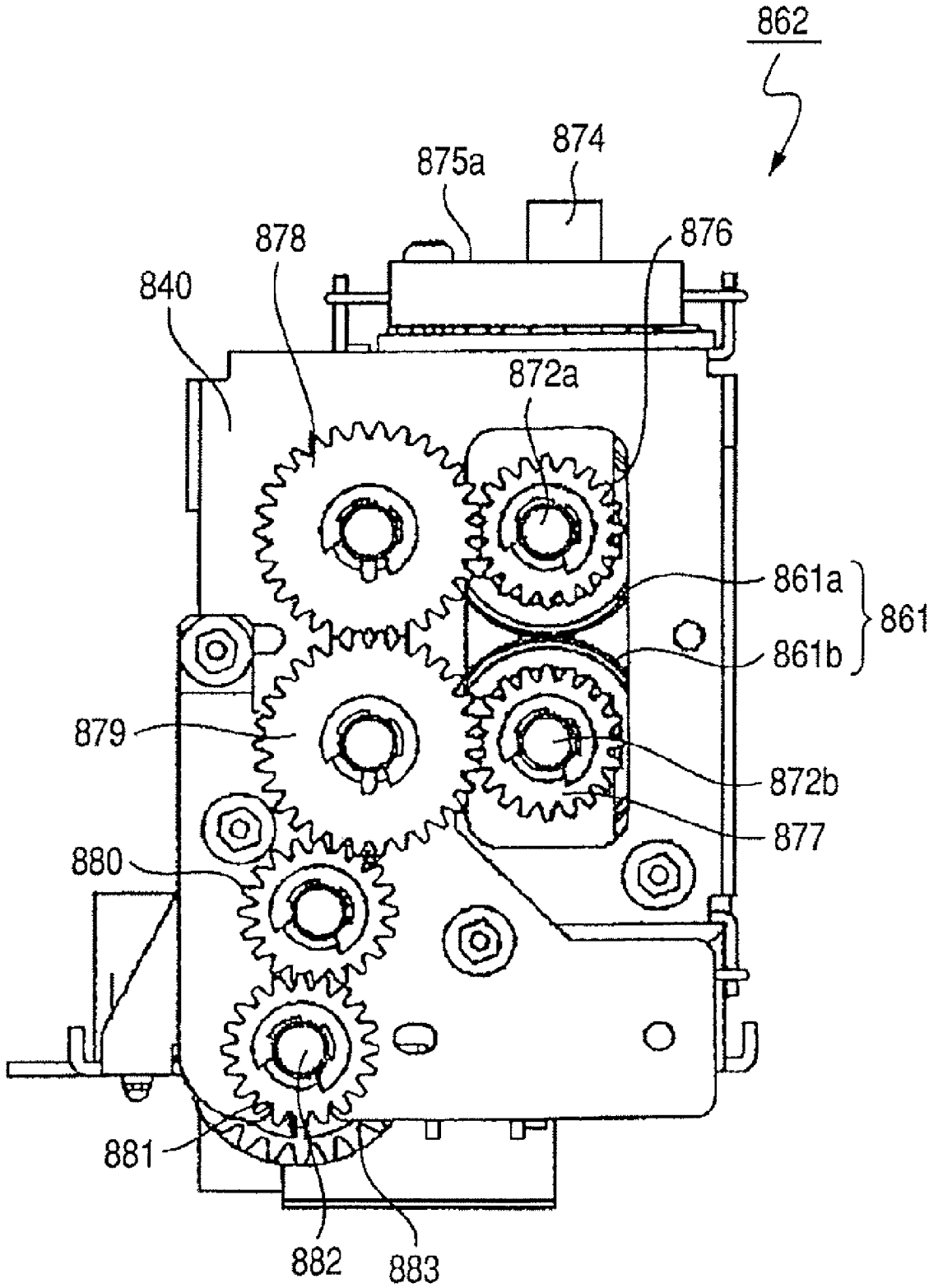
FIG. 9 is a view of the fold line press unit in the saddle-stitching bookbinding section shown in FIG. 3 as seen from the direction indicated by arrow B in FIG. 1.
Figure 10:
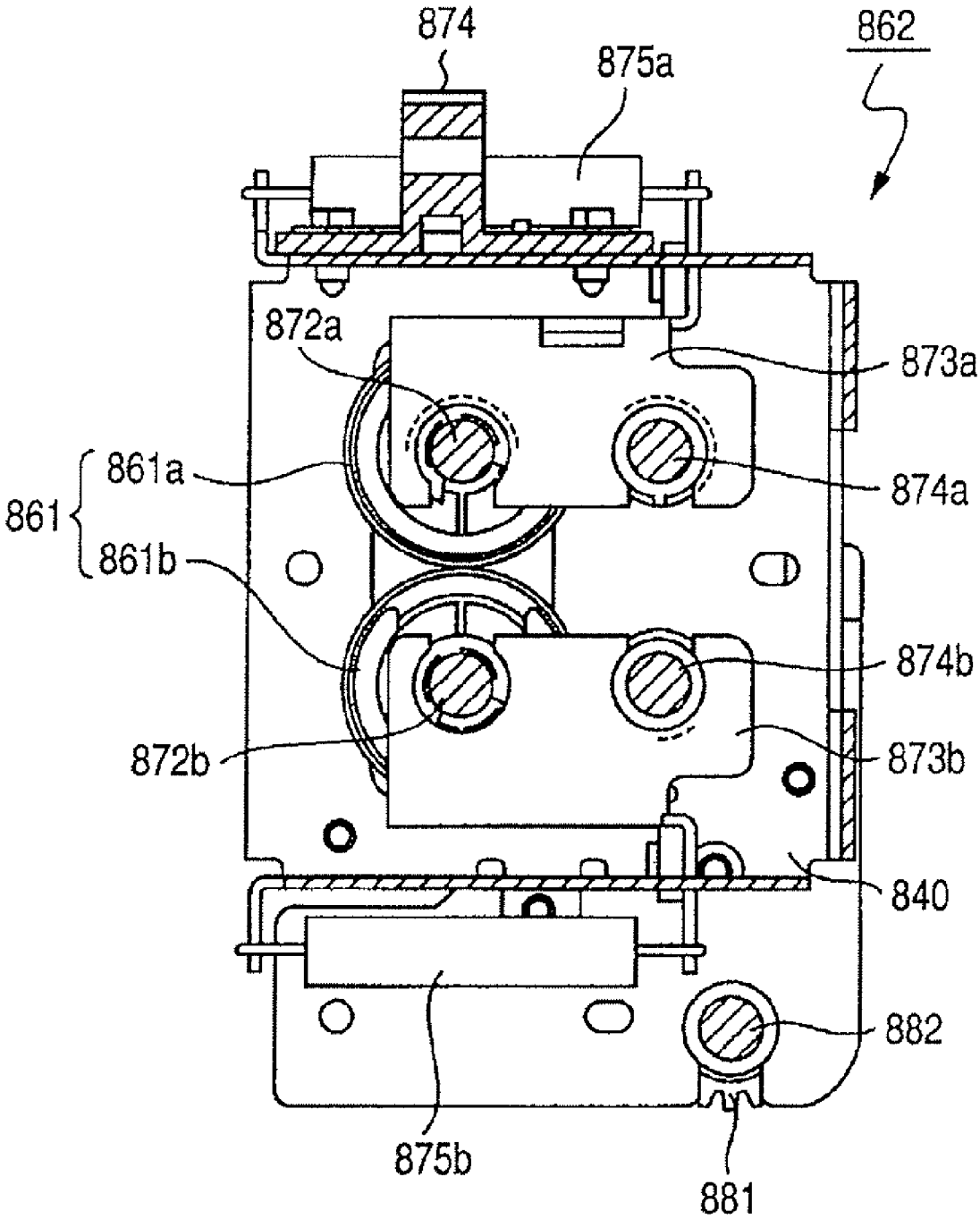
FIG. 10 is a cross-sectional view taken along line 10-10 in FIG. 8.

FIG. 7 is a perspective view showing the outer appearance of the press holder 862. FIG. 8 is a front view of the press holder 862. FIG. 9 is a view as seen from the direction indicated by arrow B in FIG. 1. FIG. 10 is a cross-sectional view taken along line 10-10 in FIG. 8.

The press holder 862 has a frame 840. Slide bearings 874 and 875 are attached on the frame 840 by screws. The pair of press rollers 861*a* and 861*b* are fixedly mounted on the roller shaft 872*a* and 872*b*, respectively, and rotatably supported on press arms 873*a* and 873*b* (FIG. 10) by means of bearings that are not shown in the drawings. The press arms 873*a*, 873*b* are supported on swing shafts 874*a*, 874*b* that are fixed on the frame 840 via bearings.

A tension spring 875*a*, 875*b* is attached between one end of each of the press arms 873*a*, 873*b* and the frame 840. The pair of press rollers 861*a*, 861*b* are pulled toward each other by the tension springs 875*a*, 875*b* to form a nip. When a sheet bundle is introduced between the pair of press rollers 861*a*, 861*b*, the press arms 873*a*, 873*b* swing about the respective swing shafts 874*a*, 874*b* as the pivots so that a clearance is created between the pair of press rollers 861*a*, 861*b*.

One end of each roller shaft 872*a*, 872*b* projects beyond the frame 840 to the exterior. Gears 876, 877 are mounted on the projecting portions the roller shafts 872*a*, 872*b*. Gears 880, 879, 878 meshing with one another are rotatably mounted on the frame 840. The gear 878 meshes with the gear 876, the gear 879 meshes with the gear 877, and the gear 880 meshes with a gear 881. This gear 881 is fixedly mounted on a gear shaft 882.

The gear shaft 882 is supported on the frame 840 via a bearing. On the other end of the gear shaft 882 (FIG. 8) is mounted a gear 883. As this gear 883 rotates, a rotational force is transmitted to the pair of press rollers 861*a*, 861*b* through the gear train, so that the press rollers 861*a*, 861*b* are rotated. The rotation directions of the pair of press rollers 861*a*, 861*b* are the same relative to the sheet bundle nipped therebetween. The gear 883 meshes with a rack gear 841 (FIGS. 3 and 5). The rack gear 841 extends parallel with the slide shafts 864, 865 and is fixedly mounted on the metal base plate 863.

Rotation of the motor M6 causes the timing belt 868 to rotate, so that the press holder 862 is moved while being supported by the slide shafts 864, 865. With this movement, the gear 883 of the press holder 862 rotates and moves while meshing with the rack gear 841. With rotation of the gear 883, the pair of press rollers 861*a*, 861*b* also rotate. The gear ratios of the gears are designed in such a way that the velocity of movement of the press holder 862 and the circumferential velocity of the pair of the press rollers 861*a*, 861*b* become equal to each other.

Figure 12:
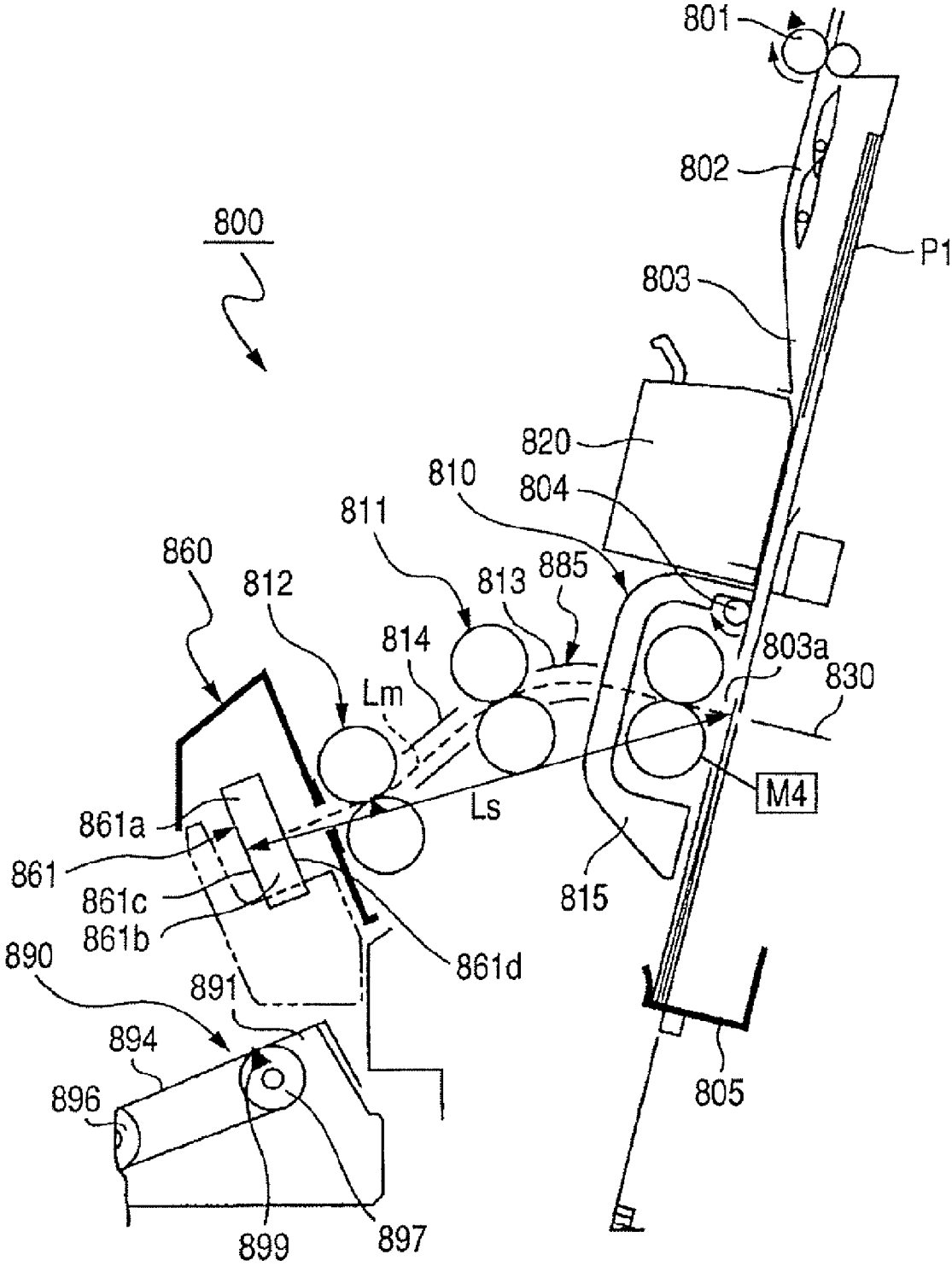
FIG. 12 illustrates a state in which a sheet bundle is stored and bound in a storage guide in the saddle-stitching bookbinding section.

The center-folded sheet bundle (hereinafter referred to as "folded sheet bundle") that has been folded at its center is subjected to fold line processing in which the fold line of the sheets is made definite by the press roller pair 861 shown in FIG. 12. During this process, the folded sheet bundle is kept stationary by one or more than one roller pair that nips the folded sheet bundle at its center with respect to the width direction thereof, irrespective of the sheet size.

Specifically, the nip pressure F3 of the second folding, conveying roller pair 812 is applied on the leading edge portion of the folded sheet bundle, the nip pressure F2 of the first folding, conveying roller pair 811 is applied on the trailing edge thereof, and nip pressure F1 of the folding roller pair 810 is sometimes applied on it simultaneously depending on the sheet size (i.e. the length in the conveyance direction) of the folded sheet bundle. Consequently, even when a torque is applied on the folded sheet bundle as it is nipped by the press roller pair 861, the above-mentioned roller pairs can hold the folded sheet bundle to prevent it from moving in spite of the torque.

The position of the leading edge of the folded sheet bundle is detected by a sensor 884 provided on the conveyance guide 814 in order to keep constant the positional relationship between the position of the leading edge (the position of leading edge during it is pressed) of the folded sheet bundle at the time when it is stopped upon fold line processing for making the folded portion at the leading edge of the folded sheet bundle definite and the press roller pair 861, irrespective of the sheet size.

On the other hand, as to the position of the trailing edge (the position of trailing edge during it is pressed) during fold line processing, the positions of the various components are arranged in such a way that the trailing edge of the folded sheet bundle does not obstruct storage of the succeeding sheets conveyed into the storage guide 803, namely in such a way that the trailing edge of the folded sheet bundle does not project into or is not left in the storage guide 803. Specifically, the direct or shortest distance Ls of the guide path 885 from a discharge portion 803*a*, at which the sheet bundle stored in the storage guide 803 is thrust by the thrust member 830 so as to be discharged, to a position of the downstream direction surface 861*c* of the press roller pair 861 in the nip is arranged to be shorter than the length L1 (along the conveyance direction) of the folded sheet bundle of the maximum size that is subjected to the fold line processing(Ls<L1). The guide path 885 starts at the discharge portion 803*a* of the storage guide 803 and ends at the downstream direction surface 861*c* of the press roller pair 861.

The guide path 885 composed of the conveyance guide 813, 814 is curved gently so as not to create a permanent curl of the folded sheet bundle. The length Lm of the guide path 885 extending from the discharge portion 803*a* of the storage guide 803 to the downstream direction surface 861*c* of the press roller pair 861 through the pair of folding rollers 810 and the conveyance guides 813, 814 is arranged to be longer than the length L1 (along the conveyance direction) of the folded sheet bundle of the maximum size that is subjected to the fold line processing (Lm>L1).

Figure 15:
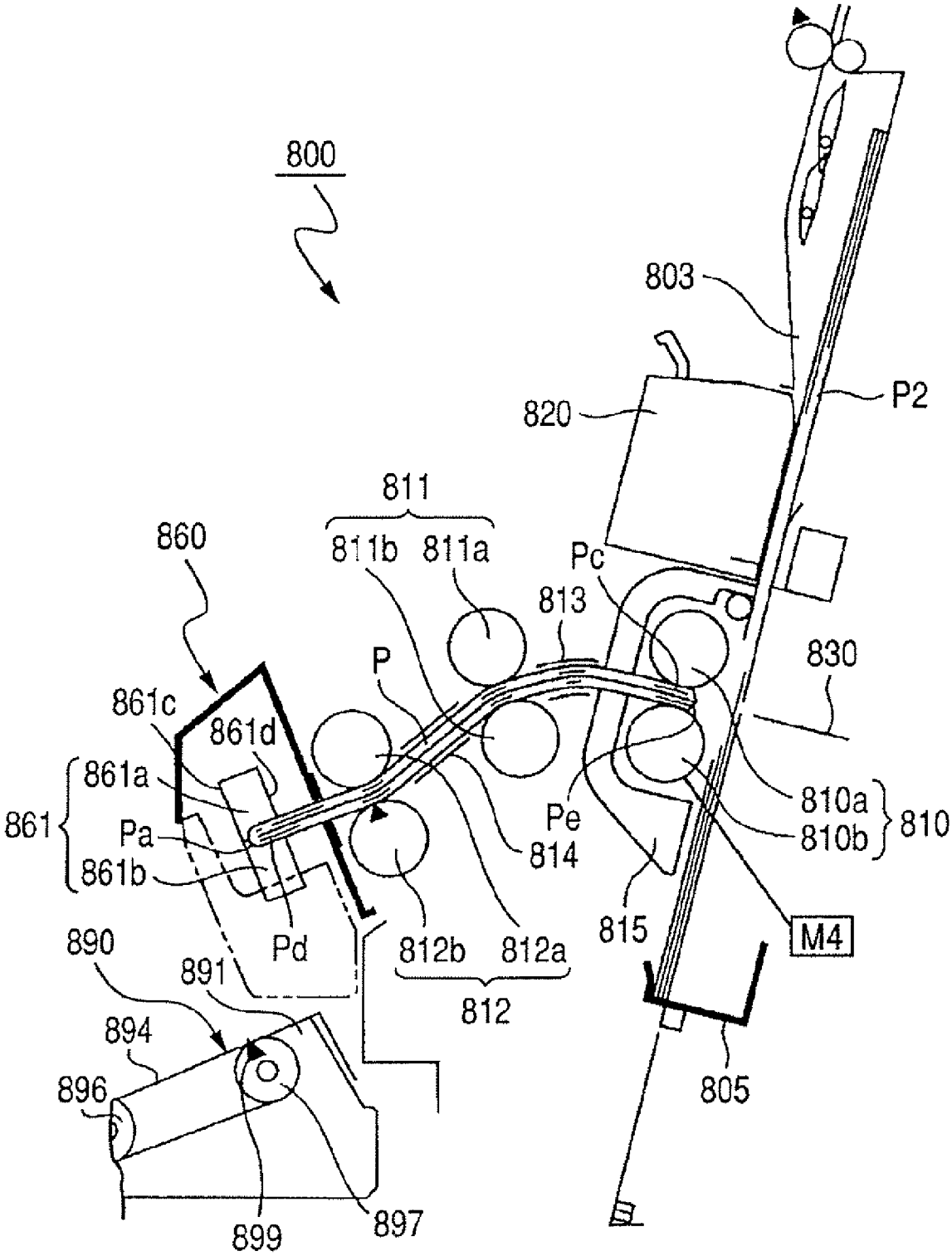
FIG. 15 illustrates a state in which the saddle-stitching bookbinding section has conveyed the folded sheets to a press roller pair.

In some cases, the press roller pair 861 performs the fold line processing on the sheet bundle in the state in which the leading edge Pa of the folded portion of the sheet bundle is positioned near the downstream direction surface 861*c* of the press roller pair 861 in the nip (FIG. 15). In other cases, the fold line processing is performed in the state in which the leading edge Pa is positioned near the upstream direction surface 861*d* of the press roller pair 861 in the nip. In still other cases, the fold line processing is performed in the state in which the leading edge Pa is positioned between the above-mentioned positions. However, it is preferred that the fold line processing be performed in the state in which the leading edge of the sheet bundle is positioned in the nip at the center of the downstream direction surface 861*c* and the upstream direction surface 861*d* of the press roller pair 861. To this end, it is preferred that the path length between the center position and the discharge portion 803*a* be longer than the afore-mentioned sheet length L1 and the direct, shortest distance between the center position and the discharge portion 803*a* be shorter than the afore-mentioned sheet length L1.

As per the above, by the above-described feature "Ls<L1" of the guide path 885 and gentle curvature of the conveyance guides 813, 814, the conveyance guides 813, 814 together with the press holder 862 can be accommodated in the space between the storage guide 803 (FIG. 1) and the trailing edge guide 710.

By the above-described feature "Ls<L1", it is possible to arrange the saddle-stitching bookbinding section 800 above the folded bundle tray 890 in a overlapping manner utilizing the vertically extending space in which the folded bundle tray 890 and the fold line press unit 860 are placed. Thus, it is possible to shorten the horizontal length of the apparatus.

In the saddle-stitching bookbinding section 800, by the above-described feature "Lm>L1", the open side trailing edge portion Pc (FIG. 15) of the folded sheet bundle P is not left in the storage guide 803 in an open state while the folded sheet bundle P is subjected to the fold line processing by the press roller pair 861, and therefore the trailing edge portion Pc is not curled. Consequently, the trailing edge portion Pc of the center-folded sheet bundle does not open or spread, and therefore it is possible to enhance the appearance of the sheet bundle.

In addition, in the saddle-stitching bookbinding section 800, by the above-described feature "Lm>L1", the trailing edge portion Pc of the folded sheet bundle is not left in the storage guide 803, and therefore succeeding sheets can be sequentially stored in the storage guide while the fold line processing is applied on the folded sheet bundle. Consequently, the trailing edge portion Pc of the center-folded sheet bundle does not open or spread, and therefore it is possible to enhance the appearance of the sheet bundle. In addition, it is possible to improve efficiency of sheet bundle processing by the saddle-stitching bookbinding section 800 by shortening the time interval of the fold line processing on sheet bundles or shortening the distance between the preceding sheet bundle and the succeeding sheet bundle.

The nip angle of the second folding, conveying roller pair 812 that discharges the sheet bundle onto the folded bundle tray 890 at the most downstream position in the guide path 885 is designed in such way that the folded sheet bundle is discharged in a downwardly inclined state. This design is adopted in order that the second folding, conveying roller pair 812 can discharge the folded sheet bundle below the stack tray 700 without fail even when a large amount of sheets are stacked on the stack tray 700 and the stack tray 700 has been lowered to the vicinity of the folded bundle tray 890.

Next, the structure of the folded bundle tray 890 will be described with reference to FIG. 1. The folded bundle tray 890 serving as a sheet stack portion has the first stack surface 891, the second stack surface 892 and the third stack surface 893 that are arranged continuously. Folded sheet bundles discharged by the second folding, conveying roller pair 812 that serves as a sheet discharge portion is stacked on the folded bundle tray 890. In the case where the first stack surface 891 has a length sufficient for allowing stacking of folded sheet bundles, the second stack surface 892 and the third stack surface 893 are not necessarily required. In the case where the second stack surface 892 is not needed, the second conveyor belt 895 that will be described later is also unnecessary, needless to say.

The first stack surface 891 is arranged beneath the fold line press unit 860 in a spatially overlapping manner and inclined downwardly toward the downstream with respect to the conveyance direction of the sheet bundle. The angle of this inclination is arranged to be substantially equal to the discharge angle of the second folding, conveying roller pair 812. The top of the inclined surface of the first stack surface 891 is arranged as high as possible while being prevented from interfering with the operation of the fold line press unit 860. Thus, the drop distance from the second folding, conveying roller pair 812 to the first stack surface 891 is set as short as possible. The second stack surface 892 is inclined relative to the inclined surface of the first stack surface 891, where the second stack surface 892 is inclined in the direction opposite to the inclination of the first stack surface 891 (i.e. inclined upwardly toward the downstream direction with respect to the sheet conveyance direction). The third stack surface 893 is arranged parallel with the second stack surface 892 with a step therebetween. It is preferred that the angle of inclination of the first stack surface 891 be approximately 20 to 25 degrees downward from the horizontal plane, and the angle of inclination of the second stack surface 892 be approximately 10 to 15 degrees upward from the horizontal plane.

The first stack surface 891 and the second stack surface 892 are provided with the first and second conveyor belts 894 and 895 that serve as sheet bundle moving members for conveying folded sheet bundles stacked thereon. Both the first and the second conveyor belts 894, 895 are wound at one end thereof on a drive pulley 896 provided near the angled portion. The other end of the first conveyor belt 894 is wound on an idler pulley 897. The other end of the second conveyor belt 895 is wound on an idler pulley 898.

The first and the second conveyor belts 894, 895 are driven by a conveyor motor M7 connected to the shaft of the drive pulley 896 to rotate in the same forward or backward direction.

On the first stack surface 891 is provided a sheet bundle detection sensor 899 that can detect a center folded sheet bundle that is placed directly below the operation region of the fold line press unit 860. The sheet bundle detection sensor 899 is adapted to detect the stack position of the folded sheet bundle discharged.

The member providing the third stack surface 893 is accommodated beneath the second stack surface 892 in an extendable manner. When the member providing the third stack surface 893 is accommodated in the position illustrated by the broken line, a storage box 852 having a height equal to the height from the floor to the idler pulley 898 may be placed on the floor. Thus, it is possible to increase the number of the folded sheet bundles that can be stacked.

Next, an inserter 900 provided in the upper portion of the finisher 500 will be described with reference to FIG. 1. The inserter is an apparatus for inserting a sheet (insert sheet) that is different from ordinary sheets into the top, the bottom or an intermediate position of sheets (recording sheets) on which images have been formed by the printer section 300. The insert sheets inserted to the top and bottom are cover sheets.

The inserter 900 is adapted to feed a sheet set by a user on an insert tray 901, 902 to one of the sample tray 701, the stack tray 700 and the folded bundle tray 890 without passing it through the printer section 300. The inserter 900 separates sheets stacked on the insert trays 901, 902 page by page and supplies a separated sheet into the finisher path 520 at a desired timing.

FIG. 11 is a block diagram of a control system of the copying machine 1000. A CPU circuit part 150 has a CPU (not shown). The CPU circuit part 150 is adapted to control an original feeding control part 101, an image reader control part 201, an image signal control part 202, a printer control part 301, a folding process control part 401, a finisher control part 515 and external I/F 203 based on a control program stored in a ROM 151 and setting by an operation part 1. The original feeding control part 101 is adapted to control the original feeding portion 100, the image reader control part 201 is adapted to control the image reader section 200, the printer control part 301 is adapted to control the printer section 300, and the folding process control part 401 is adapted to control the folding process section 400. The finisher control part 501 is adapted to control the finisher 500, the saddle-stitching bookbinding section 800 and the inserter 900. The operation part 1 has multiple keys for setting various functions concerning image formation and a display part for displaying the setting state. The operation part 1 outputs key signals corresponding to key operations performed by a user to the CPU circuit part 150 and displays, based on signals from the CPU circuit part 150, information corresponding to the signals on the display part.

A RAM 152 is used as a memory space for temporarily storing control data and a workspace for computation required for a control process. The external I/F 203 is interface of the copying machine 1000 and an external computer 204. The external I/F 203 is adapted to develop print data from the computer 204 into bitmap image and output it as image data to the image signal control part 202. An image of an original read by the image sensor (not shown) is output from the image reader control part 201 to the image signal control part 202. The printer control part 301 is adapted to output image data from the image signal control part 202 to an exposure control part (not shown).

Next, the saddle-stitching bookbinding operation of the saddle-stitching bookbinding section 800 will be described.

When the saddle-stitching bookbinding mode is set by the user, sheets P on which images have been formed are sequentially discharged from the discharge rollers 118 (FIG. 2) of the printer section 300. The sheets P pass through the folding process section 400 and are transferred to the inlet roller pair 501 (FIG. 1), and thereafter conveyed into the discharge path 622 through the conveyance path 520. The sheet path is switched by the switching flapper 514 provided halfway in the lower discharge path 622 to the right side, and the sheets are conveyed to the saddle-stitching bookbinding section 800 through the saddle discharge path 523. The sheets are transferred to the saddle inlet roller pair 801 as shown in FIG. 12. The entranceway of the sheets is selected by the flapper 802 that is driven by a solenoid, in accordance with the sheet size, and the sheets are conveyed into the storage guide 803 of the saddle-stitching bookbinding section 800. The sheets abut the sheet positioning member 805 that has been set in a stationary state at a position suitable for the sheet size while receiving a conveying force of the slide roller 804 so as to be positioned with respect to the conveyance direction.

Subsequently, the sheets are held between and aligned by the pair of alignment plates 815 that have been kept at a standby position at which the alignment plates do not interfere with the sheets conveyed into the storage guide 803. Thus, both side edges of the sheets are aligned. As a result, the sheets are aligned at its lower edge and both side edges.

Figure 13:
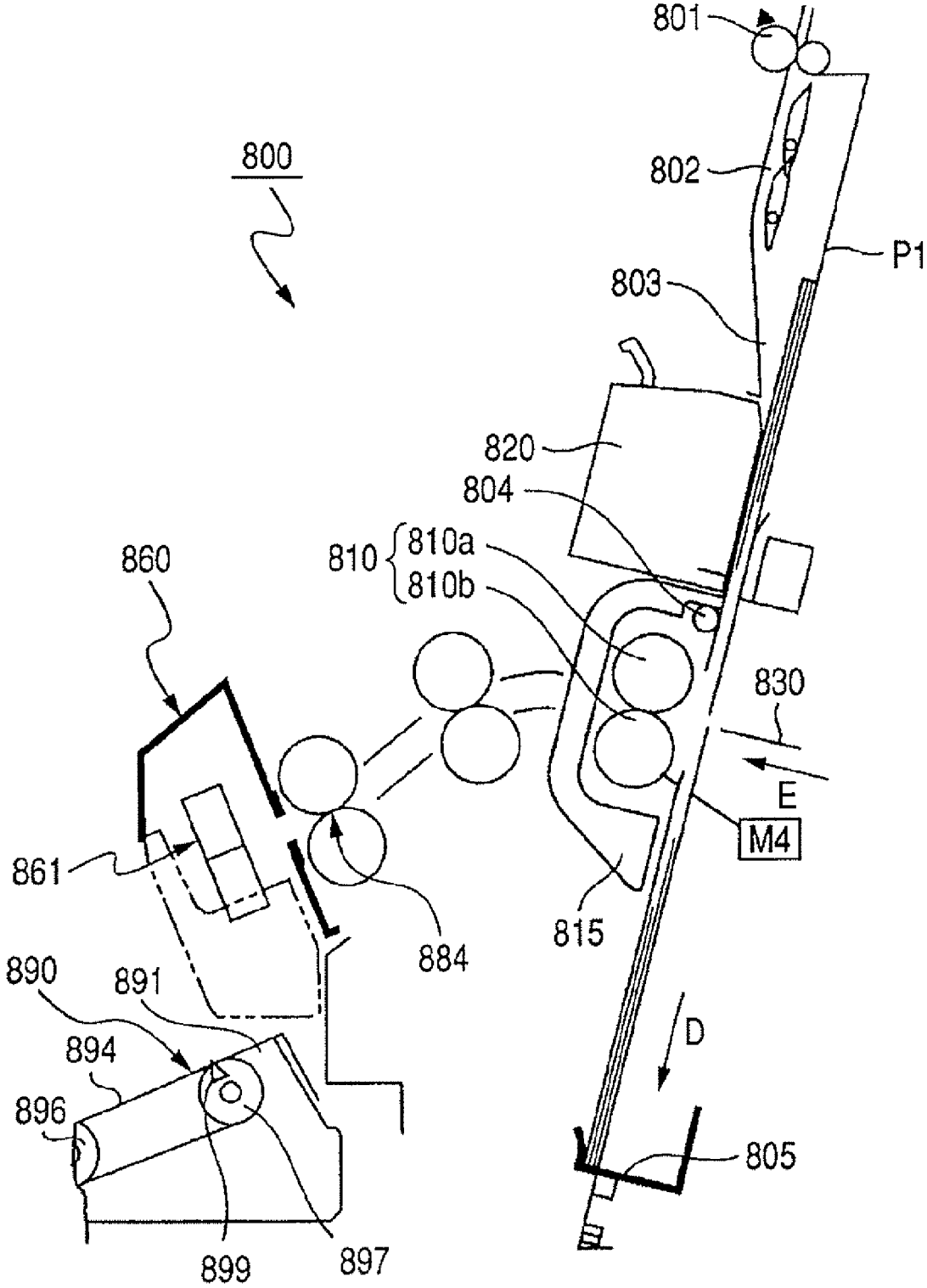
FIG. 13 illustrates a state in which bending of the bound portion of the sheet bundle stored in the storage guide in the saddle-stitching bookbinding section is to be started.

The above-described sheet storage and alignment operations are performed every time the sheet P is conveyed into the storage guide 803. After completion of alignment of the last sheet, the central portion, with respect to the conveyance direction, of the sheet bundle stored in the storage guide 803 is stapled with wire by the stapler 820. As shown in FIG. 13, the stapled bundle moves down (in the direction indicated by arrow D) as the sheet positioning member 805 is lowered. The sheet positioning member 805 is stopped at such a position that the central portion or the stapled portion of the sheet bundle is directly opposed to the nip of the folding roller pair 810.

Figure 14:
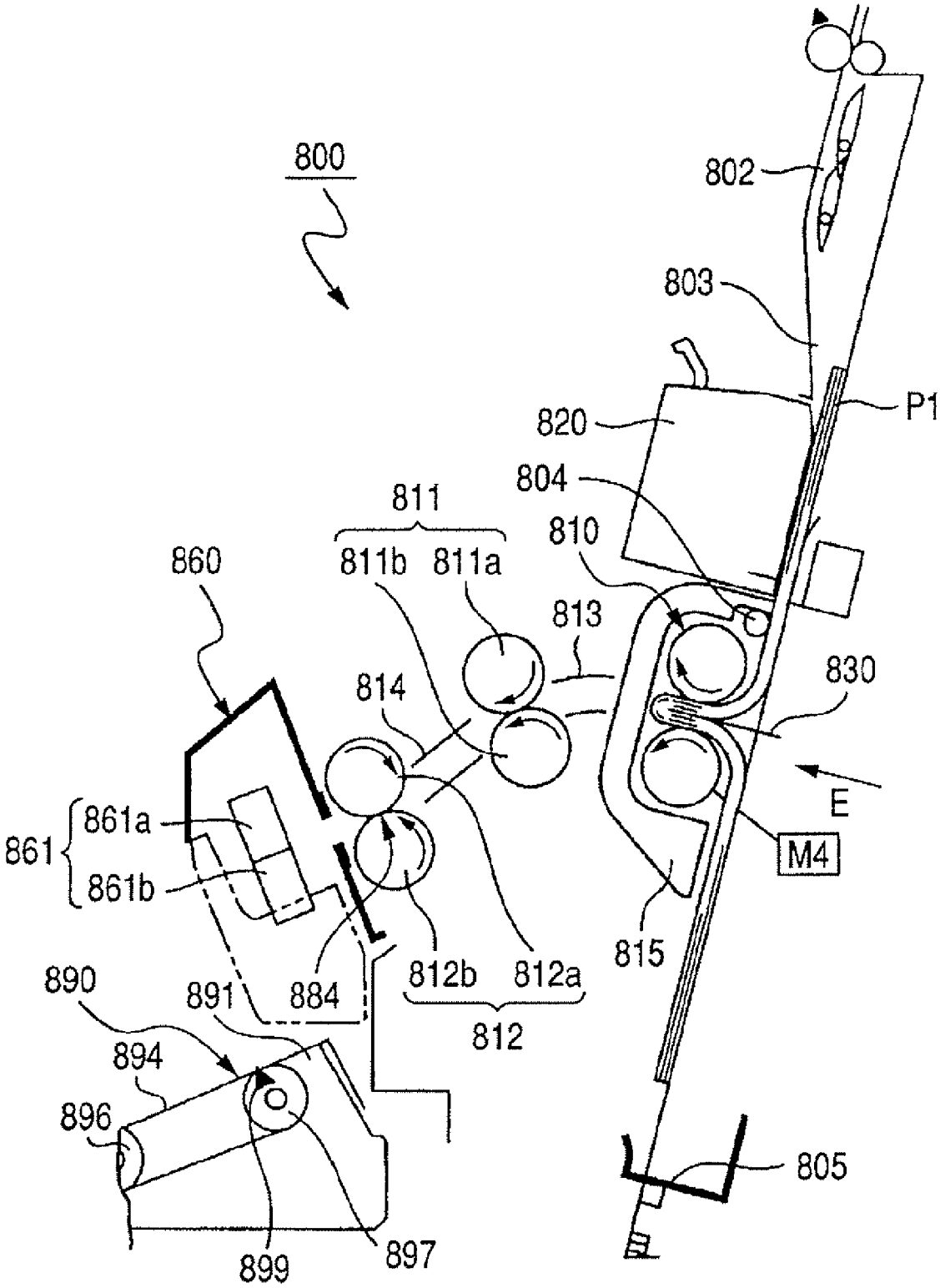
FIG. 14 illustrates a state in which the saddle-stitching bookbinding section has just started folding of the sheet bundle.

Thereafter, the thrust member 830 that has been at a standby position starts to move toward the nip of the folding roller pair 810 (in the direction indicated by arrow E) and thrusts the central portion of the sheet bundle P into the nip of the folding roller pair 810 while forcibly widening the gap of the folding roller pair 810. The folding roller pair 810 rotate to convey and fold the sheet bundle P in two while holding it in the nip (FIG. 14). In this process, not only the folding roller pair 810 but also the first folding, conveying roller pair 811 and the second folding, conveying roller pair 812 are driven by the motor M4 (FIG. 1) to rotate in the direction indicated by arrows. The sheet bundle P that has been folded (folded sheet bundle) is conveyed by these roller pairs 810, 811, 812 with the folded portion being the leading edge. The folded sheet bundle is conveyed through the conveyance guides 813, 814.

As shown in FIG. 15, when the folded sheet bundle P conveyed to the position at which it is nipped by the press roller pair 861, the leading edge Pa of the folded portion is detected by the sensor 884 (FIG. 1), and then the motor M4 is stopped to suspend the conveyance. At that time, the leading edge portion P, which is the folded portion, of the folded sheet bundle P is held by the second folding, conveying roller pair 812 and the trailing edge portion thereof is held by the first conveying roller pair 811. The folded sheet bundle P is also held by the folding roller pair 810 in some cases depending on the size (or the length along the conveyance direction) of the folded sheet bundle. Each roller pair 812, 811, 810 holds the sheet bundle in a symmetric manner with respect to the center of the sheet bundle with respect to the width direction. After thrusting has been completed, the thrust member 830 is retracted to the standby position again. In connection with the above, the leading edge portion Pd as the folded portion includes the tip part Pa of leading edge.

Figure 16:
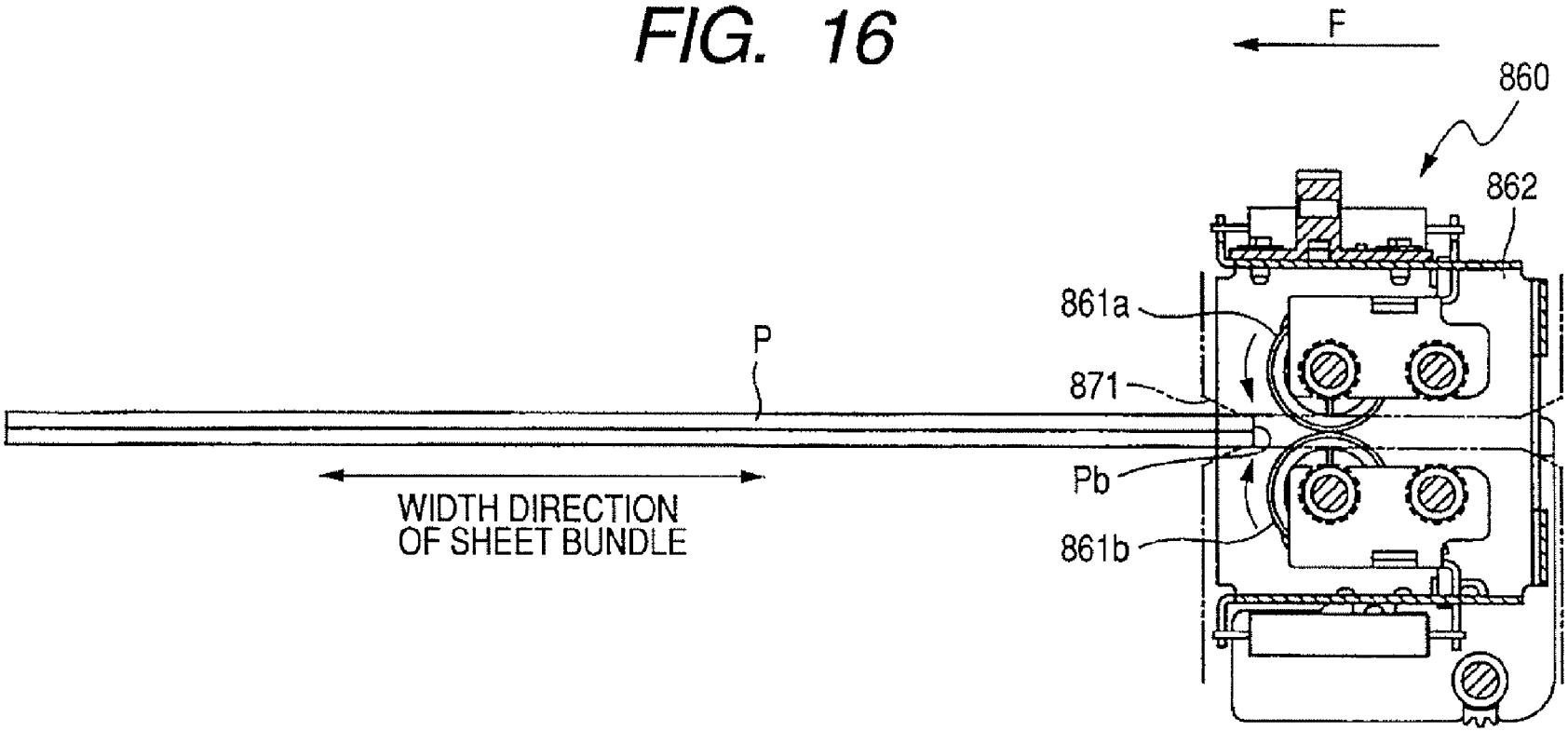
FIG. 16 illustrates a state in which the press roller pair of the saddle-stitching bookbinding section is about to start the operation of definitely forming a fold line in the folded portion of the folded sheets.

As shown in FIG. 16, before the conveyance of the sheet bundle P by the roller pairs 812, 811, 810 (FIG. 15), the press holder 862 is kept at a standby position (in the back side) that changes depending on the size (or width) of the folded sheet bundle P. As the folded sheet bundle P has been made stationary and the folded portion of the folded sheet bundle P is inserted into the sheet guide 871 (illustrated by the chain line), the motor M6 (FIG. 6) is started, and the fold line press unit 860 starts to move toward the front side (in the direction indicated by arrow F, along the width direction of the sheet bundle), while the press roller pair 861 is rotating.

Figure 17:
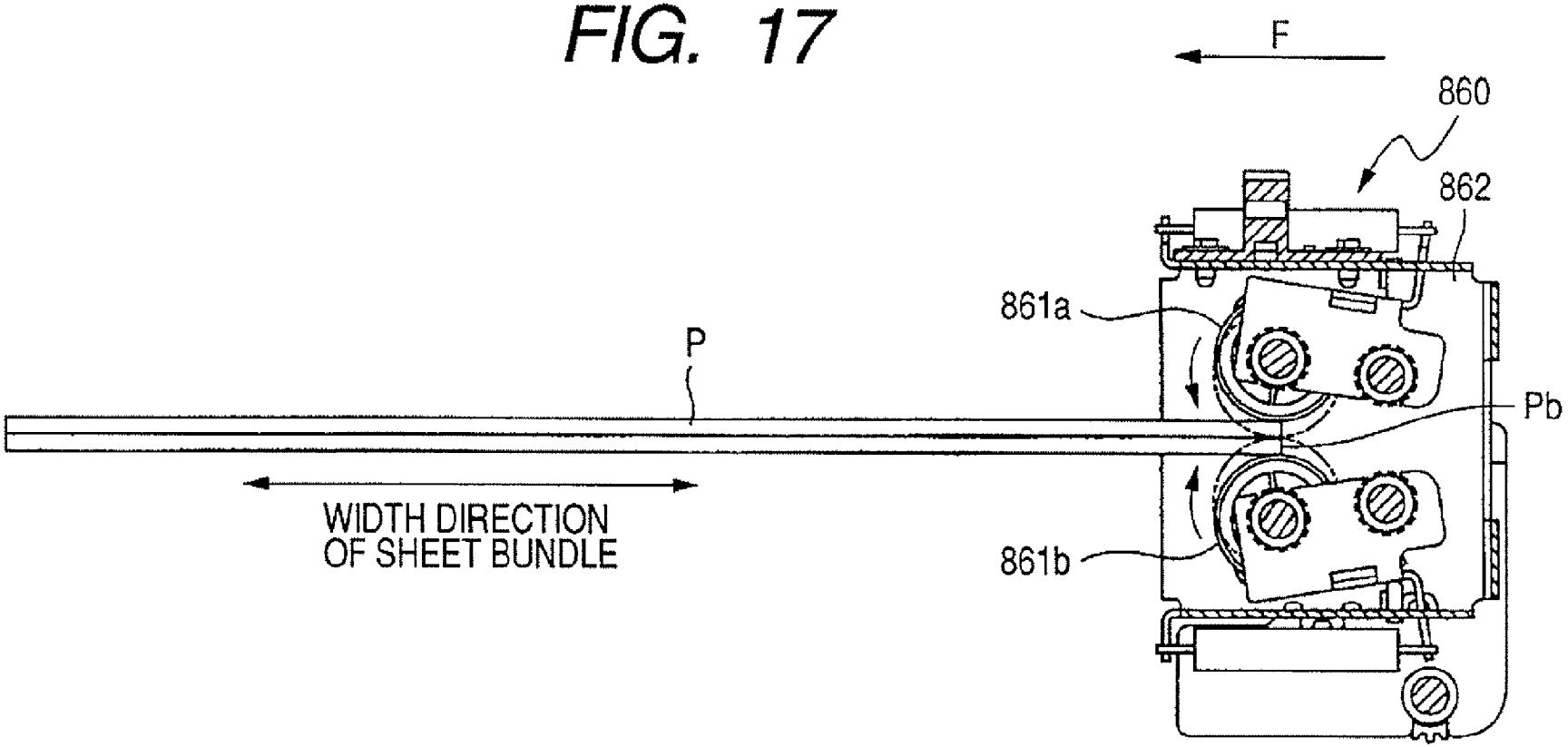
FIG. 17 illustrates a state in which the press roller pair of the saddle-stitching bookbinding section has just started the operation of definitely forming a fold line in the folded portion of the folded sheets.
Figure 18:
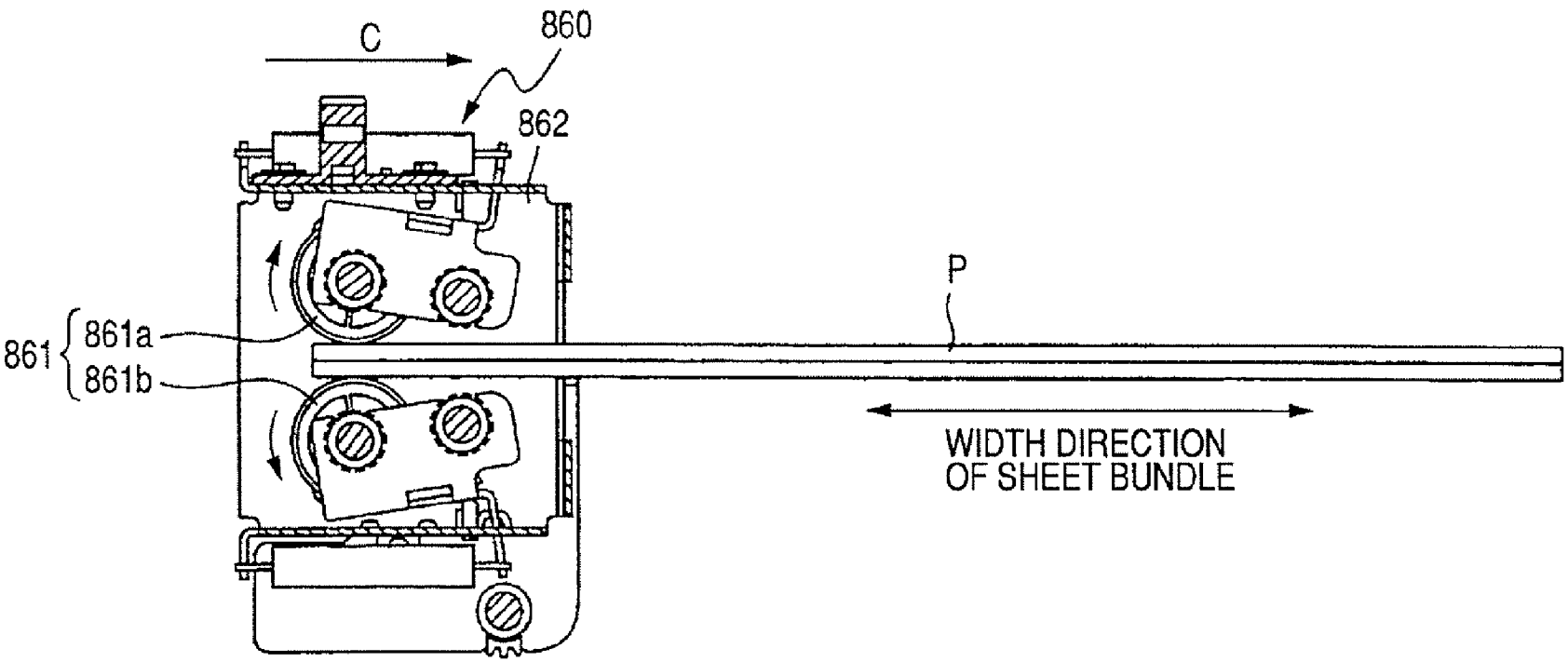
FIG. 18 illustrates a state in which the press roller pair of the saddle-stitching bookbinding section has just finished the operation of definitely forming a fold line in the folded portion of the folded sheets.

Thereafter, the press roller pair 861 abuts a side edge portion Pb, which runs along the sheet conveyance direction, of the folded sheet bundle P that is held stationary. Since both of the two press rollers 861*a*, 861*b* are rotating, they receive the side edge portion Pb of the folded sheet bundle P and ride on the side edge portion smoothly to hold the folded portion therebetween (FIG. 17). The press roller pair 861 can nip the folded sheet bundle in synchronization with the movement of the press holder 862 without a response delay as always even if the thickness of the folded sheet bundle becomes large. Therefore, the press roller pair 861 can form a fold line definitely at the folded portion of the folded sheet bundle P without breaking the folded sheet bundle P or damaging the folded sheet bundle P by for example forming a wrinkle or a roller trace.

The pairs of rollers 812, 811, 810 may be replaced by pairs of belts.

Figure 19:
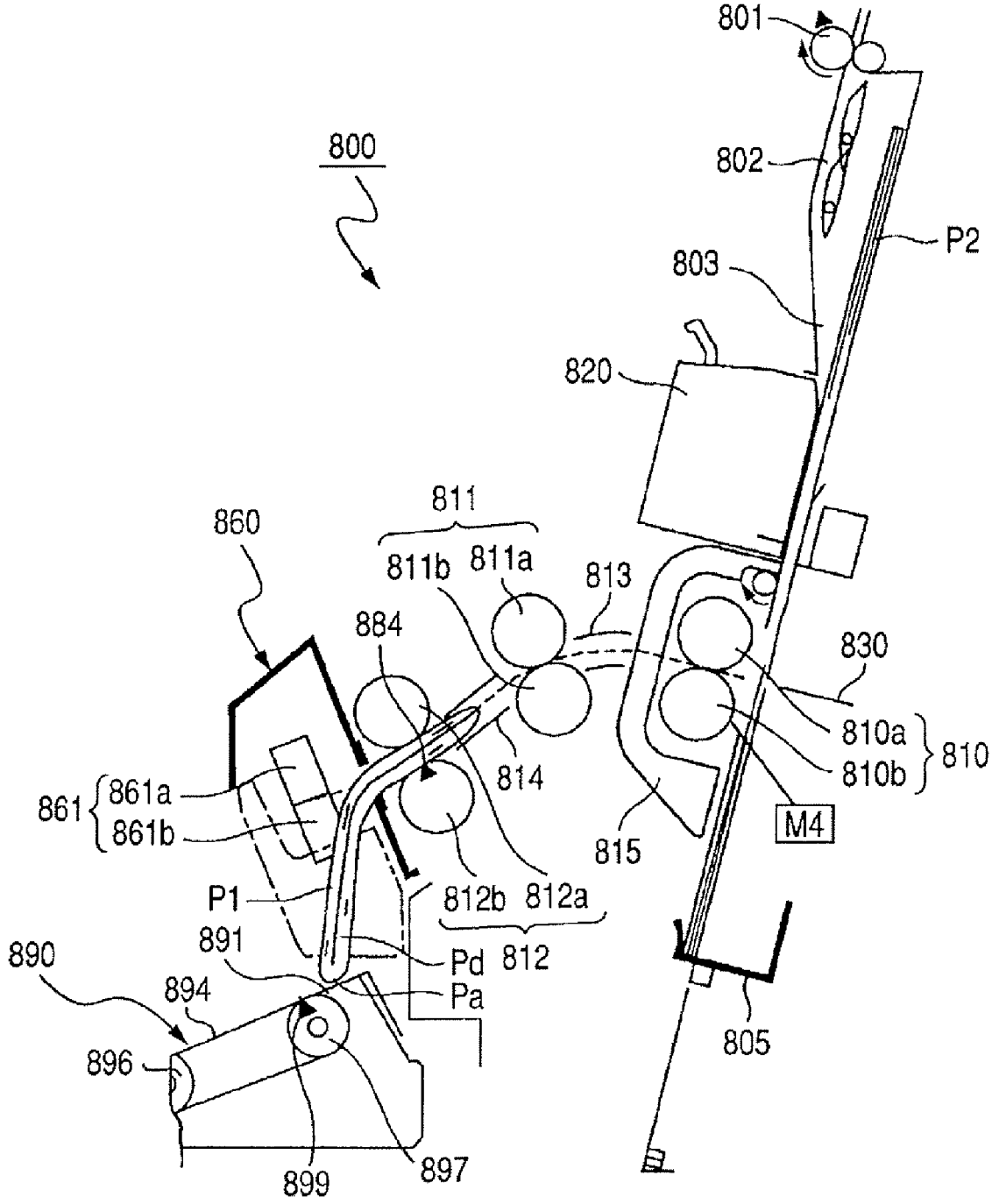
FIG. 19 illustrates a state in which the center folded sheet bundle is discharged by a second folding, conveying roller pair of the center folding bookbinding section.

After the press roller pair 862 have reciprocated a predetermined number of times, the fold line press unit 860 is moved to the home position to open the path of the folded sheet bundle P1 in the conveyance direction. Thereafter, as shown in FIG. 19, the folded sheet bundle P1 (the reference sign of the sheet bundle has been changed from P to P1 to distinguish the preceding sheet bundle and the succeeding sheet bundle) that has been kept stationary starts to be conveyed by the motor M4 again and is discharged onto the folded sheet bundle tray 890 by the second folding, conveying roller pair 812. During the discharge process, the leading edge portion Pd of the folded sheet bundle P1 droops down due to its own weight and is transferred onto the first stack surface 891. The first stack surface 891 is inclined at the position near the second folding, conveying roller pair 812 by an angle substantially equal to the sheet bundle discharge angle of the second folding, conveying roller pair 812. Thus, the folded sheet bundle P1 is transferred smoothly onto the first stack surface 891. Even in the case of a folded sheet bundle made of thin paper sheets with a low stiffness, as the leading edge portion Pd of the folded sheet bundle lands on the first stack surface 891, the folded sheet bundle is stably discharged without problems such as buckling or curling.

Figure 20:
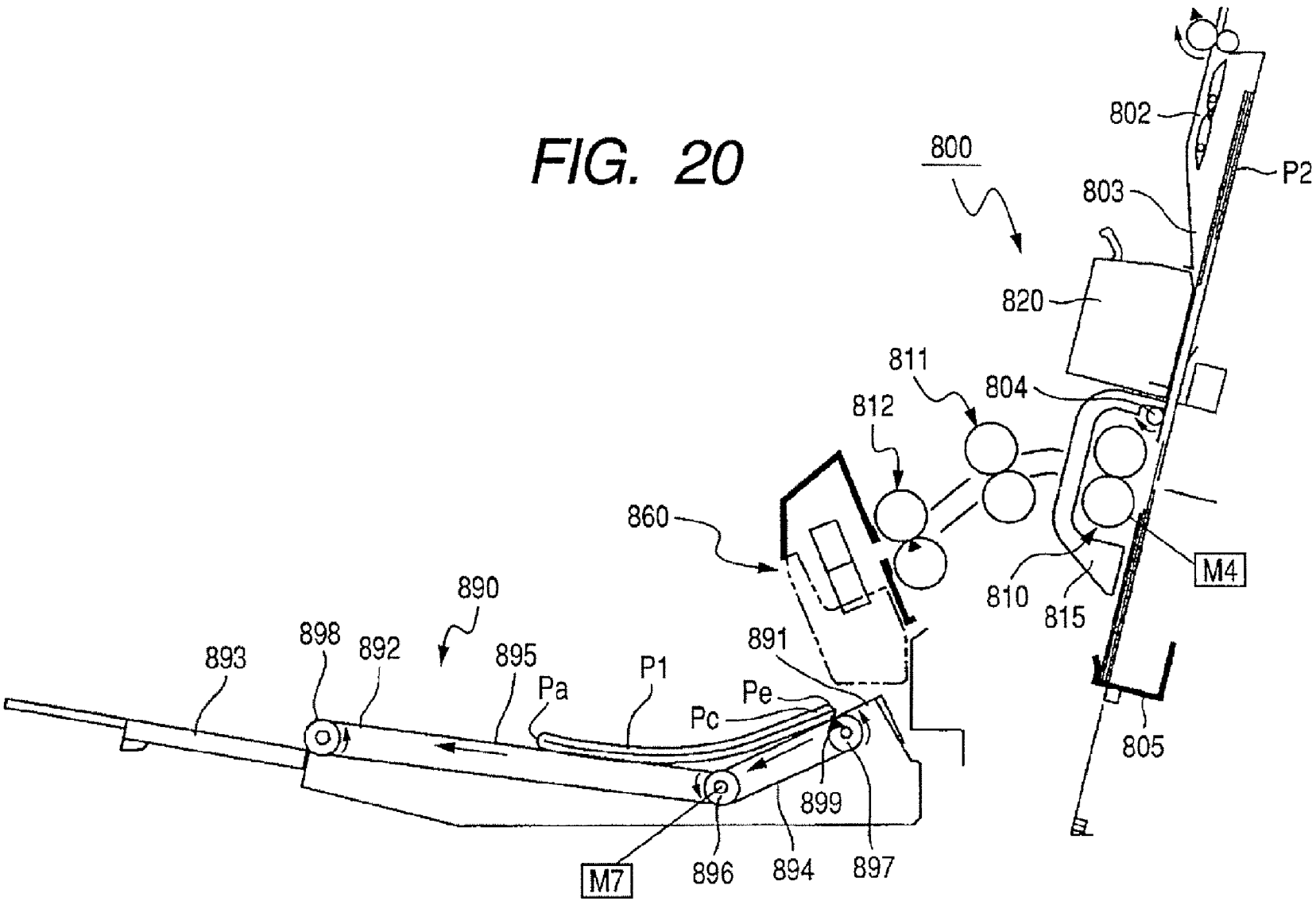
FIG. 20 illustrates a state in which the preceding center folded sheet bundle is stacked on a folded bundle tray.

As shown in FIG. 20, the first and the second conveyor belts 894, 895 start to be rotate by the conveyor motor M7 in the downstream direction with respect to the sheet conveyance direction at predetermined timing to convey the folded sheet bundle P1 discharged onto the folded bundle tray 890 in the downstream direction. When the bundle detection sensor 899 detects the trailing edge Pe of the folded sheet bundle P1, the rotation of the conveyor motor M7 is stopped. In connection with the above, the trailing edge portion Pc or the open portion includes the tip part Pe of the trailing edge.

Since the bundle sensor 899 is disposed directly below the operation region of the fold line press unit 860, the entire folded sheet bundle P1 having been stopped including the trailing edge portion PC is positioned (at a first stack position) outside the operation region of the fold line press unit 860.

While the preceding folded sheet bundle P1 is discharged onto the folded bundle tray 890 in the above-described manner, the next (or succeeding) folded sheet bundle P2 undergoes discharge and alignment operations. In addition, the succeeding folded sheet bundle P2 is also subjected to the fold line enhancing process by the fold line press unit 860. Since the preceding folded sheet bundle P1 is placed at the first stack position, it does not interfere with the press unit 860 or obstruct the fold line enhancing process performed by the press unit 860. Furthermore, when the preceding folded sheet bundle P1 is conveyed to the first stack position, it is kept away from a wall provided below the second folding, conveying roller pair 812 for sure, and therefore the trailing edge Pc thereof does not lean against the wall to be curled.

Figure 21:
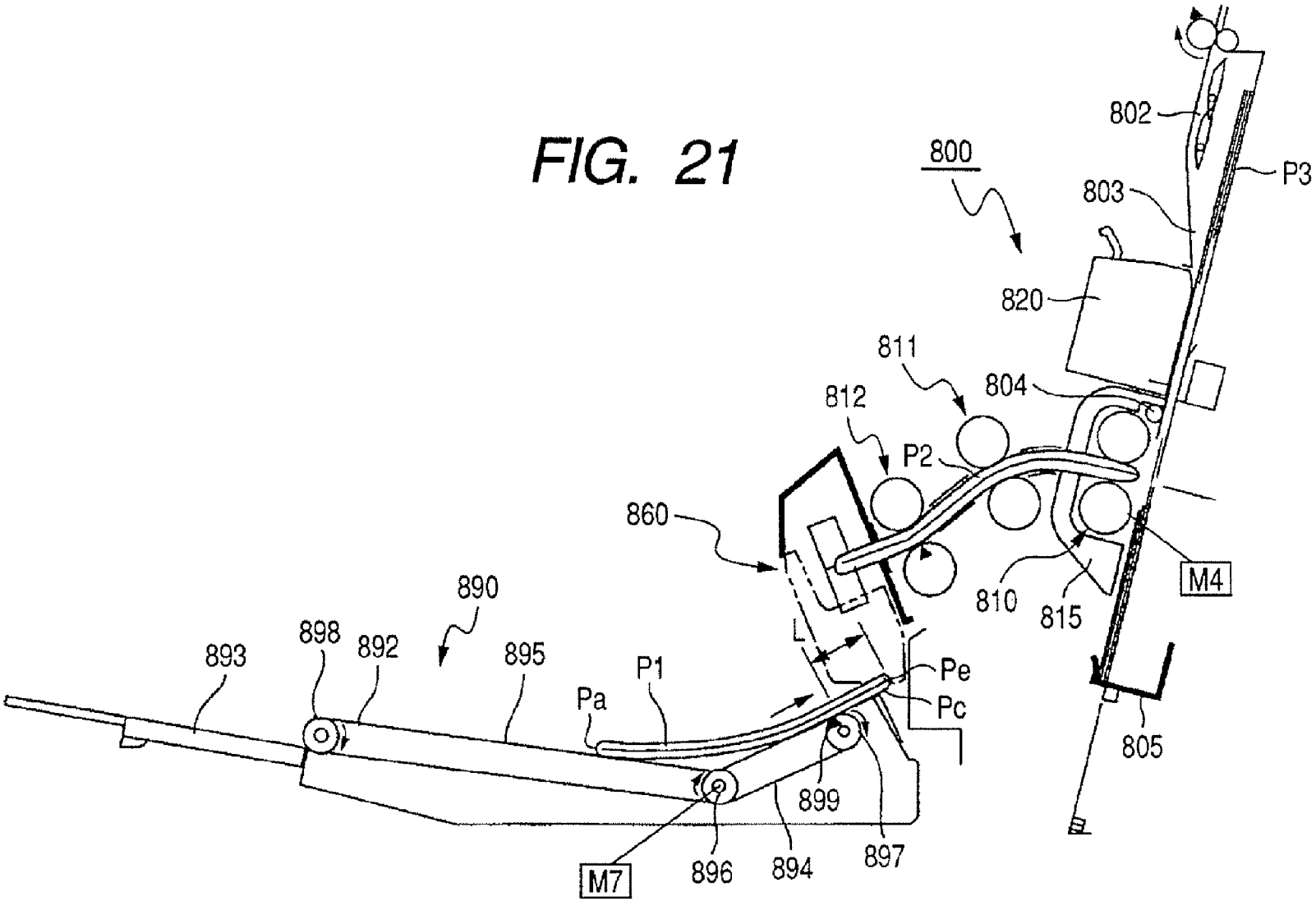
FIG. 21 illustrates a state in which the preceding center folded sheet bundle has been moved back in the upstream direction.

As shown in FIG. 21, after the fold line press unit 860 is returned to the home position after completion of the fold line processing on the succeeding folded sheet bundle P2, the first and the second conveyor belts 894, 895 are driven by the conveyor motor M7 toward the upstream of the sheet conveyance direction. By this operation, the preceding folded sheet bundle P1 at the first stack position is moved closer to the second folding, conveying roller pair 812 by a predetermined distance L. This position will be referred to as the second stack position.

Figure 22:
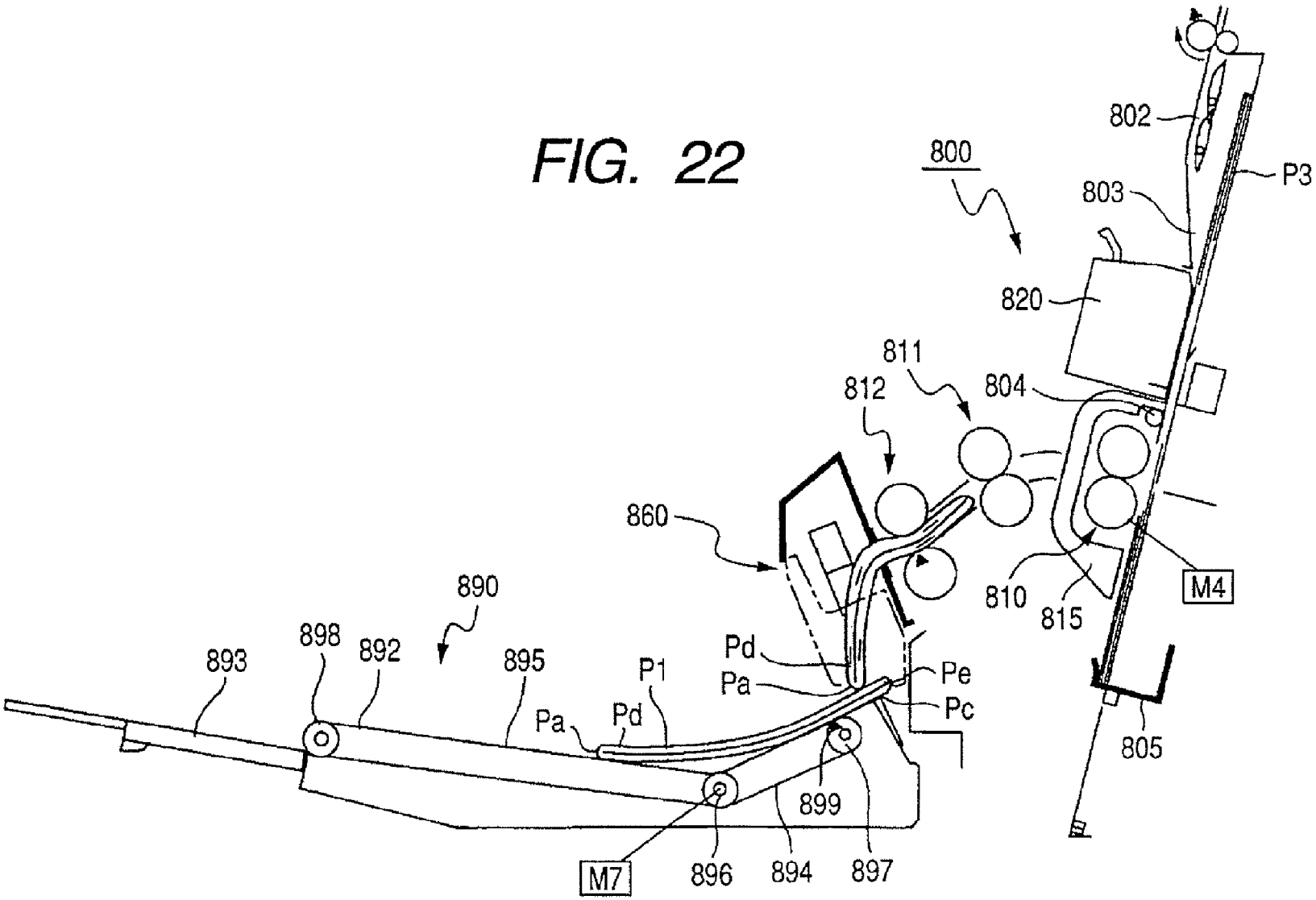
FIG. 22 illustrates a state in which the succeeding center folded sheet bundle is about to be stacked onto the preceding center folded sheet bundle.

After that, the motor M4 starts to rotate again as shown in FIG. 22. Then, the succeeding folded sheet bundle P2 is discharged from the second folding, conveying roller pair 812. The leading edge portion Pd of the succeeding folded sheet bundle P2 droops down due to its own weight. At that time, the trailing edge Pe of the preceding folded sheet bundle P1 is at a position upstream of the leading edge Pa of the succeeding folded sheet bundle P2. Accordingly, the succeeding folded sheet bundle P2 is stacked on the preceding folded sheet bundle P1 while sliding on the upper surface thereof.

The fold line of the preceding folded sheet bundle P1 has been sufficiently enhanced by the fold line press unit 860, and its trailing edge portion Pc does not become open. As described above, the saddle-stitching bookbinding section 800 is adapted to discharge the succeeding folded sheet bundle P2 onto the preceding folded sheet bundle P1 after moving the preceding folded sheet bundle P1 to the second stack position. Therefore, the leading edge Pa of the succeeding folded sheet bundle P2 does not get into the open trailing edge portion Pc of the preceding folded sheet bundle P1. Even in the case where the succeeding folded sheet bundle is a sheet bundle that is made of thin sheets with a low stiffness and likely to droop down, the succeeding folded sheet bundle does not get into the open trailing edge portion Pc of the preceding folded sheet bundle P1. Consequently, the succeeding folded sheet bundle P2 is stably stacked in such a displaced manner that the leading edge Pa of the succeeding folded sheet bundle P2 presses the trailing edge portion Pc of the preceding folded sheet bundle P1 from above without causing any failure such as getting stuck with the preceding folded sheet bundle P1.

Therefore, the frequency of jamming of the folded sheet bundle, improper stacking and bending of the sheet in the saddle-stitching bookbinding section 800 is low.

While the succeeding folded sheet bundle P2 is discharged, the first and the second conveyor belts 894, 895 rotate in such a direction as to convey the sheet bundle in the downstream direction. Consequently, the preceding and the succeeding folded sheet bundles p1, p2 are stacked in a displaced state in which the leading edge portion Pa of the succeeding folded sheet bundle P2 presses the trailing edge portion Pc of the preceding folded sheet bundle P1 against the folded bundle tray 890.

Figure 23:
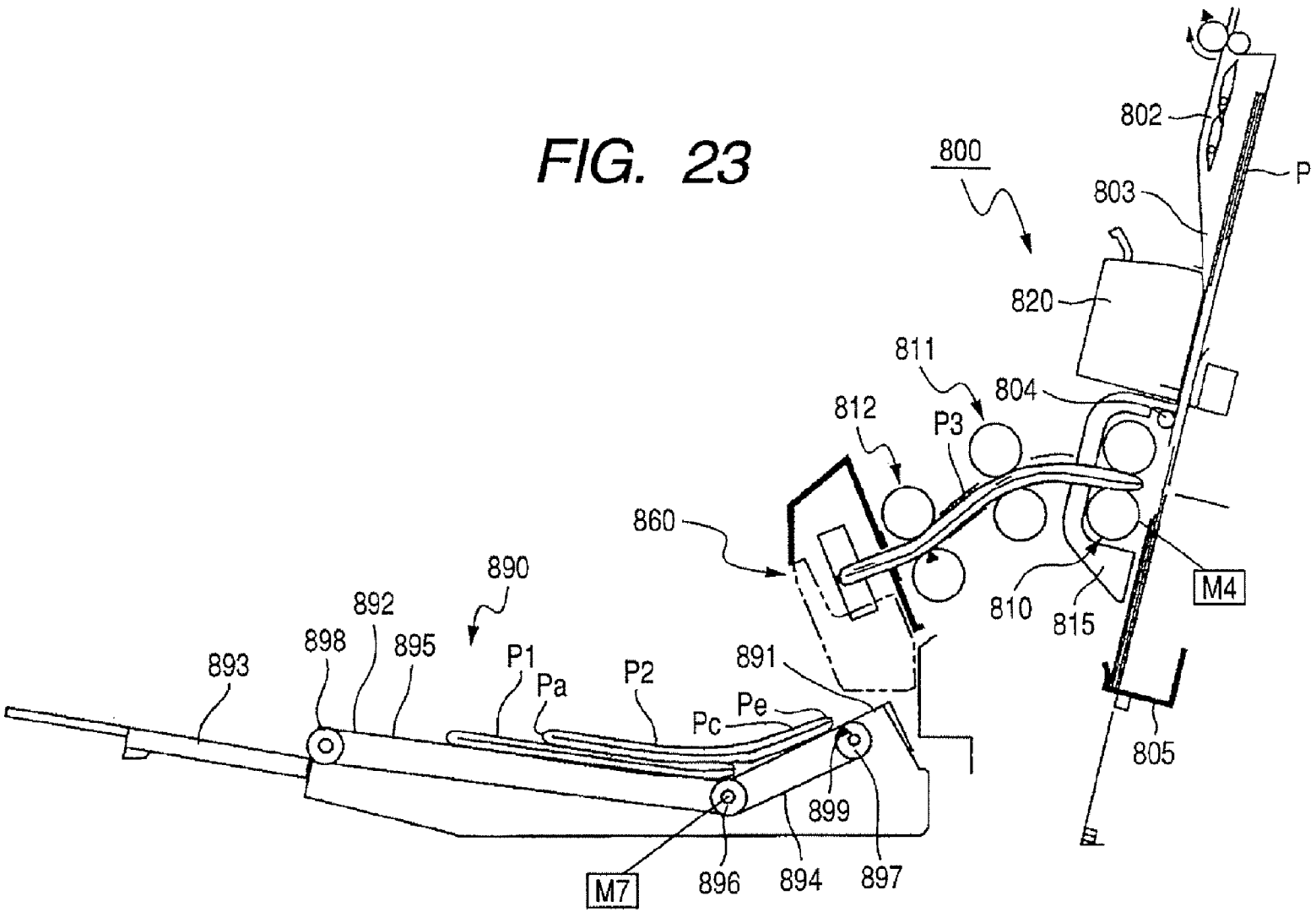
FIG. 23 illustrates a state in which the succeeding center folded sheet bundle is stacked on the preceding center folded sheet bundle.
Figure 24:
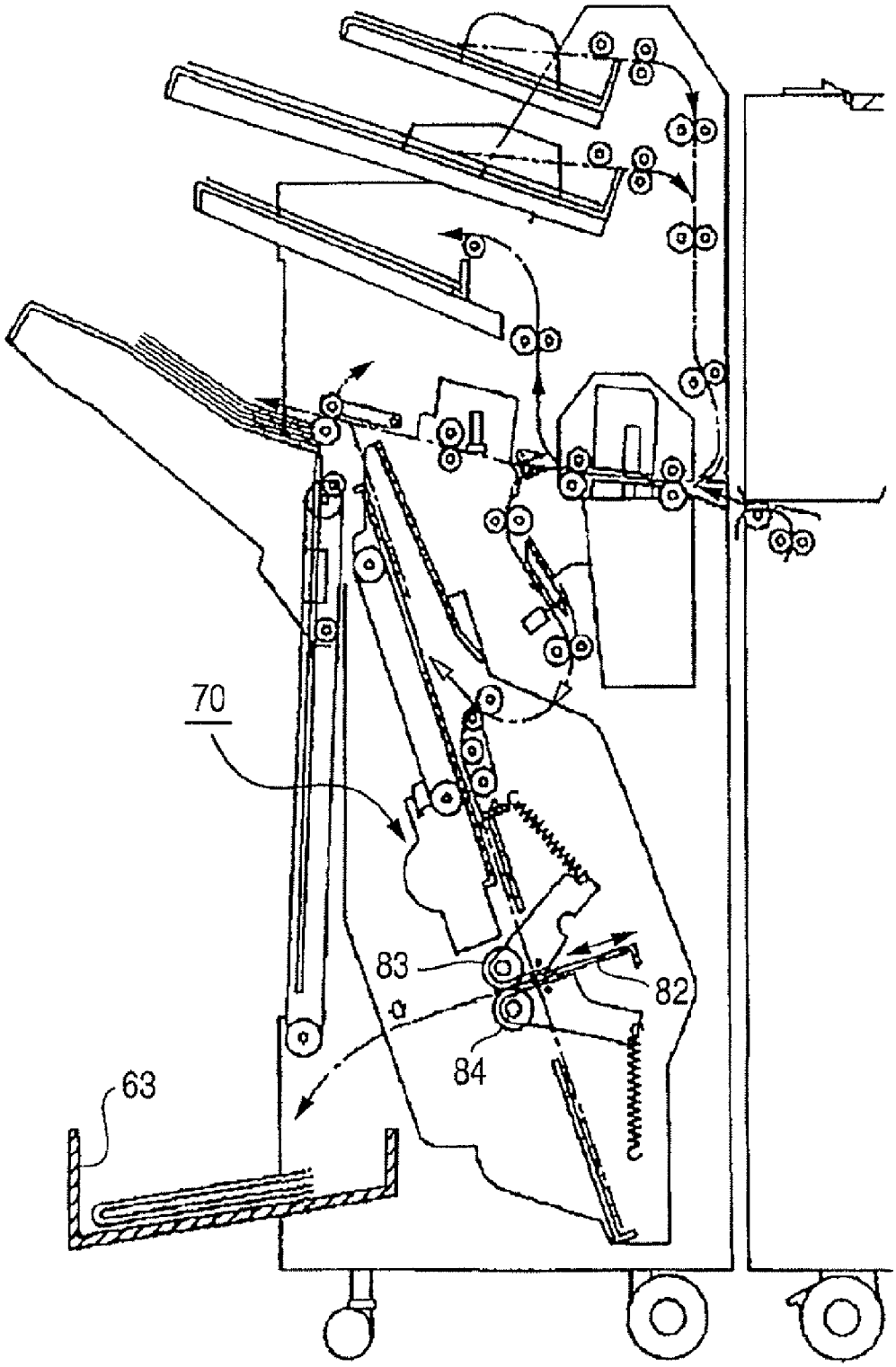
FIG. 24 is a front view of a conventional sheet processing apparatus.
Figure 25:
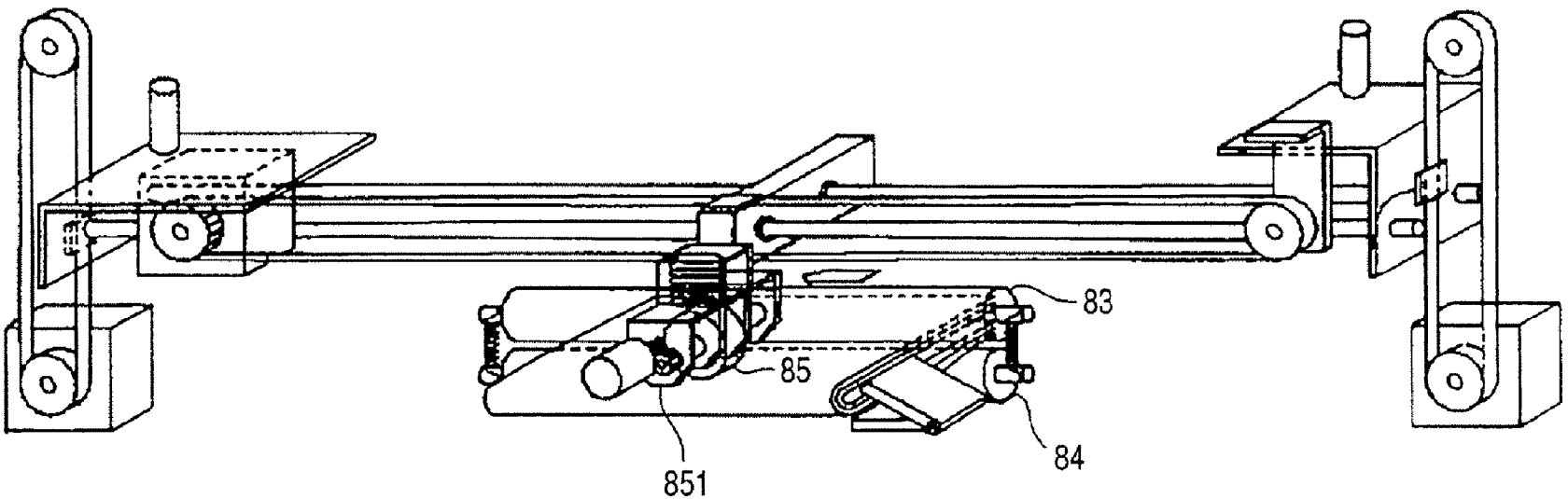
FIG. 25 is a perspective view of a drive mechanism for a second folding roller in the conventional sheet processing apparatus.
Figure 26A:
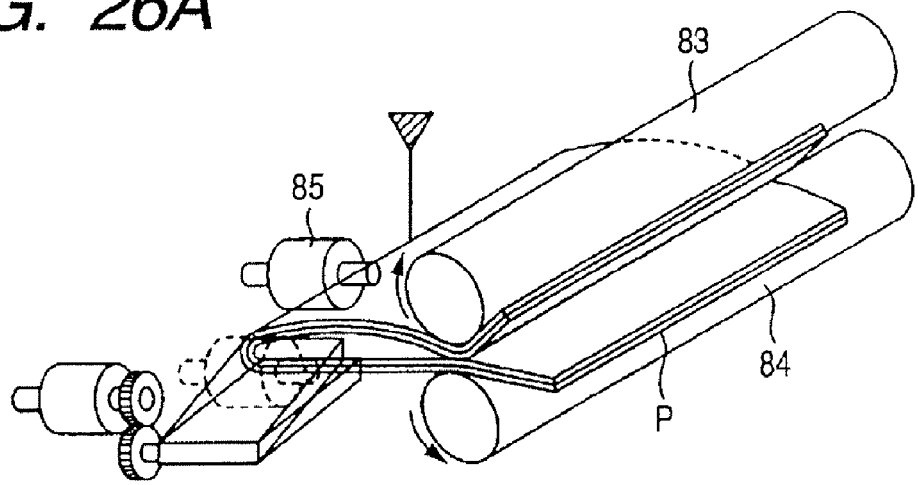
FIGS. 26A, 26B and 26C illustrate operations of the conventional sheet processing apparatus.
Figure 26B:
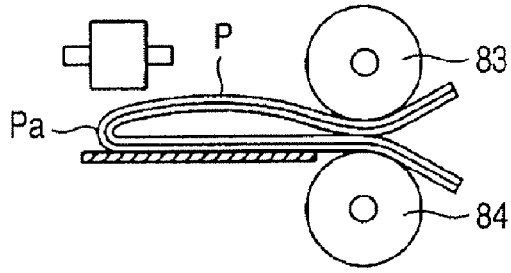
Figure 26C:
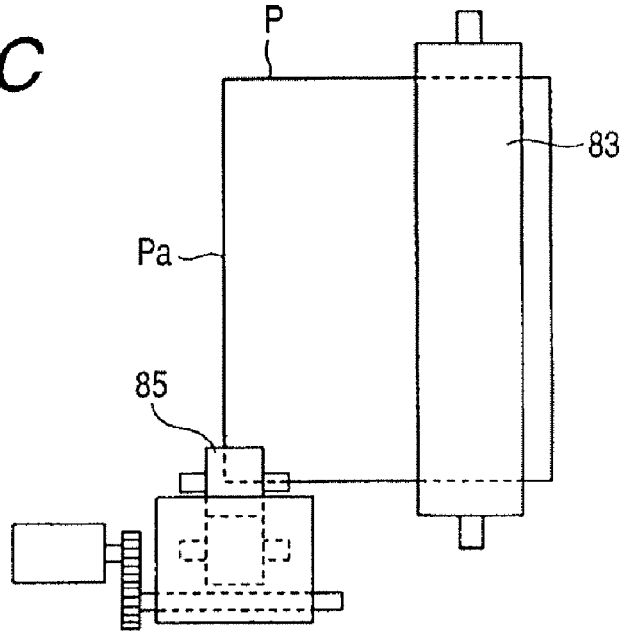

As shown in FIG. 23, when the trailing edge Pe of the succeeding folded sheet bundle P2 is detected by the bundle detection sensor 899, the rotation of the first and the second conveyor belts 894, 895 are reversed. Then, the preceding and the succeeding folded sheet bundles P1, P2 are moved toward the upstream direction and stopped when the succeeding folded sheet bundle P2 comes to the first stack position. The above-described operation is repeatedly performed for the further succeeding folded sheet bundle P3 up to the last folded sheet bundle, so that a desired number of folded sheet bundles are regularly stacked in such a way that they are displaced from each other.

As the number of the stacked bundle increases, the first folded sheet bundle P1 climbs up the inclined second stack surface 892 in the downstream direction with respect to the discharge direction. Since the folded sheet bundles P are conveyed with their folded portion being the leading edge, the open side trailing edge portion Pc thereof does not open or spread. Therefore, the folded sheet bundles moves on the second stack surface 892 in a stable state.

In addition, since the folded sheet bundles are guided upwardly by the second stack surface 892 that is inclined upwardly toward its downstream end, they cay be easily picked up by the user.

Furthermore, by putting the member providing the third stack surface 893 to accommodate it under the second stack surface 892 and placing a storage box 852 (FIG. 1) at the position where the third stack surface 893 had been, it is possible to increase the capacity of the storage box 852 (FIG. 1), since the downstream end of the second stack surface 892 is at a raised position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-252901, filed Aug. 31, 2005, which is hereby incorporated by reference herein in its entirety.

What is claimed is:

1. A sheet processing apparatus comprising:

a sheet discharge portion which discharges a folded sheet bundle with a folded portion as a leading edge;

a sheet stack portion which stacks the folded sheet bundle discharged from said sheet discharge portion, said sheet stack portion including a sheet moving member which moves the stacked sheet bundle in a sheet discharge direction, and in an opposite direction to the sheet discharge direction; and a controller which controls said sheet moving member to move a preceding sheet bundle stacked on said sheet stack portion so that the preceding sheet bundle is stacked while being moved in the sheet discharge direction and to move the preceding sheet bundle stacked on said sheet stack portion in a direction opposite to the sheet discharge direction before a folded portion of a succeeding sheet bundle contacts the preceding sheet bundle so that a contact portion between the preceding sheet bundle and the succeeding sheet bundle is on an upper surface of the preceding sheet bundle.

2. A sheet processing apparatus according to claim 1, wherein the preceding sheet bundle is moved in the sheet discharge direction after the folded portion of the succeeding sheet bundle contacts the preceding sheet bundle.

3. A sheet processing apparatus according to claim 1, further comprising a folded portion processing unit which processes the folded portion of the sheet bundle which projects from said sheet discharge portion by a predetermined amount, wherein an open portion opposed to the folded portion of the folded sheet bundle stacked on said sheet stack portion being at a downstream position, in the sheet discharge direction, of an operation region of said folded portion processing unit.

4. A sheet processing apparatus according to claim 3, wherein said sheet moving member moves the preceding sheet bundle in the sheet discharge direction after the succeeding sheet bundle has been processed by said folded portion processing unit and the folded portion of the succeeding sheet bundle contacts the preceding sheet bundle.

5. An image forming apparatus comprising:

an image forming portion which forms an image on a sheet; and a sheet processing apparatus on which a sheet bundle is stacked, the sheet bundle being formed by arranging sheets into a bundle and folding the bundle, wherein said sheet processing apparatus includes:

(a) a sheet discharge portion which discharges a folded sheet bundle with a folded portion being the leading edge;

(b) a sheet stack portion which stacks the folded sheet bundle discharged from said sheet discharge portion, said sheet stack portion including a sheet moving member which moves the stacked sheet bundle in a sheet discharge direction and in an opposite direction to the sheet discharge direction; and (c) a controller which controls said sheet moving member to move a preceding sheet bundle stacked on said sheet stack portion so that the preceding sheet bundle is stacked while being moved in the sheet discharge direction and to move the preceding sheet bundle stacked on said sheet stack portion in a direction opposite to the sheet discharge direction before a folded portion of a succeeding sheet bundle contacts the preceding sheet bundle so that a contact portion between the preceding sheet bundle and the succeeding sheet bundle is on an upper surface of the preceding sheet bundle.

6. An image forming apparatus according to claim 5, wherein the preceding sheet bundle is moved in the sheet discharge direction after the folded portion of the succeeding sheet bundle contacts the preceding sheet bundle.

* * * * *